US007914103B2

(12) United States Patent
Katayama et al.

(10) Patent No.: US 7,914,103 B2
(45) Date of Patent: Mar. 29, 2011

(54) LIQUID DROPLET JETTING APPARATUS

(75) Inventors: Naoki Katayama, Kariya (JP); Masatomo Kojima, Ichinomiya (JP); Atsushi Ito, Nagoya (JP); Masashi Ono, Okazaki (JP); Keiji Kura, Nagoya (JP); Shohei Koide, Nagoya (JP); Shigeru Suzuki, Nagoya (JP); Yasuhiro Sekiguchi, Nagoya (JP); Yoshitsugu Morita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 188 days.

(21) Appl. No.: 12/411,296

(22) Filed: Mar. 25, 2009

(65) Prior Publication Data

US 2009/0244129 A1 Oct. 1, 2009

(30) Foreign Application Priority Data

Mar. 27, 2008 (JP) ..... 2008-082491
Mar. 27, 2008 (JP) ..... 2008-082492

(51) Int. Cl.
*B41J 29/38* (2006.01)

(52) U.S. Cl. ..... 347/19; 347/68; 347/14

(58) Field of Classification Search ..... 347/14, 347/19, 67–72
See application file for complete search history.

(56) References Cited

U.S. PATENT DOCUMENTS 5,992,963 A * 11/1999 Miyake et al. ..... 347/18
6,079,805 A * 6/2000 Kishi ..... 347/9
6,116,713 A * 9/2000 Maru ..... 347/17
6,270,180 B1 8/2001 Arakawa et al.
2004/0135832 A1 7/2004 Usuda

FOREIGN PATENT DOCUMENTS

JP H11-138798 A 5/1999
JP 2004-148784 A 5/2004
JP 2005-211711 A 8/2005
JP 2006-240261 A 9/2006

OTHER PUBLICATIONS

Japan Patent Office; Notice of Reasons for Rejection in Japanese Patent Application No. 2008-082492 (counterpart to the above-captioned U.S. patent application) mailed Apr. 13, 2010.

* cited by examiner

*Primary Examiner* — Lamson D Nguyen
(74) *Attorney, Agent, or Firm* — Baker Botts L.L.P.

(57) ABSTRACT

In a liquid droplet jetting mode of jetting liquid droplets, a controller controls a piezoelectric actuator to perform a liquid droplet jetting operation in which volume of a pressure chamber is decreased to a decreased volume smaller than a predetermined volume, and then the volume of the pressure chamber is increased to an increased volume greater than the predetermined volume, and the volume of the pressure chamber is again decreased to the decreased volume. On the other hand, in a warm-up mode of heating the liquid in the pressure chamber, the controller controls the piezoelectric actuator to perform at least one of a first warm-up operation in which the volume of the pressure chamber is changed repeatedly between the predetermined volume and the increased volume, and a second warm-up operation in which the volume of the pressure chamber is changed repeatedly between the predetermined volume and the decreased volume.

21 Claims, 19 Drawing Sheets

LIQUID DROPLET JETTING APPARATUS

CROSS REFERENCE TO RELATED APPLICATION

The present application claims priority from Japanese Patent Application No. 2008-082492, filed on Mar. 27, 2008, and Japanese Patent Application No. 2008-082491, filed on Mar. 27, 2008, the disclosure of which are incorporated herein by reference in their entirety.

BACKGROUND OF THE INVENTION

1. Field of the Invention

The present invention relates to a liquid droplet jetting apparatus.

2. Description of the Related Art

In a liquid droplet jetting apparatus, such as an ink-jet printer, a pressure wave is generated by applying a voltage to a piezoelectric actuator, and a liquid such as an ink is made to be jetted from fine holes called nozzles. Therefore, a jetting performance is substantially affected by a variation and a change in a viscosity of ink.

It is possible to reduce a variation in a material and manufacturing by enhancing a production control, but at the time of use by a user, there occurs a variation and a change in the viscosity of ink due to a day-to-day change in temperature.

To cope with this change in the viscosity of ink, attempts have been made to detect a temperature around a recording head, and to keep constant a velocity of jetting of ink by changing a voltage to be applied to the piezoelectric actuator according to the temperature detected.

Even when the voltage to be applied is changed according to the temperature detected in such manner, since there is a variation in manufacturing of components of each recording head which cannot be ignored, various sorts of ranking of the voltage to be applied is necessary. Moreover, since a waveform control for jetting droplets of ink of various sizes is necessary, when the ranking of the voltage to be applied as described above is necessary in addition to the waveform control, checking of liquid droplet control in manufacturing of the recording head becomes extremely complex.

On the other hand, a head which is provided with a warm-up function to maintain the ink temperature to be not less than a certain fixed temperature all the time by heating the ink by providing a heater to the recording head has been known. However, this provision becomes expensive. Moreover, even when such heater is provided, it is difficult to provide such heater at a position where the heater makes a direct contact with the ink, and for increasing the temperature of ink, first of all, it is necessary to increase a temperature of a surrounding site, and it takes time for warming up.

Moreover, when a voltage is applied to a piezoelectric element, a deformation directly proportional to a strength of an electric field occurs (inverse piezoelectric effect), and causes heat generation by the piezoelectric element. Therefore, for heating the ink by using this, a method in which, a piezoelectric actuator (PZT) is driven prior to jetting of ink, and the temperature of ink is increased by the heat generation has been proposed (for example, refer to United States Patent Application Publication No. 2004/0135832 (corresponds to Japanese Patent Application Laid-open No. 2004-148784)).

In a liquid droplet jetting apparatus disclosed in United States Patent Application Publication No. 2004/0135832, since a pressure chamber is also deformed when the piezoelectric element is made to be deformed, when a voltage is let to be a drive voltage same as a voltage applied during a normal drive, ink droplets are jetted. Therefore, the drive voltage is controlled to be low at the time of increasing the ink temperature.

However, when the drive voltage is controlled to be low, an amount of deformation of the piezoelectric actuator is not much substantial, and a sufficient effect in heating the ink cannot be expected.

SUMMARY OF THE INVENTION

An object of the present invention is to provide a liquid droplet jetting apparatus which is capable of heating a liquid efficiently without making the liquid jet in a case of heating the liquid by controlling a drive of a piezoelectric actuator for stabilizing a jetting performance of the liquid.

According to a first aspect of the present invention, there is provided a liquid droplet jetting apparatus which jets droplets of a liquid, including a liquid droplet jetting head having a cavity unit in which a pressure chamber extending in a predetermined direction and having a predetermined volume and a nozzle communicating with the pressure chamber are formed, and a piezoelectric actuator which is joined to the cavity unit to cover the pressure chamber, and which applies pressure to the liquid in the pressure chamber; and a controller which controls the piezoelectric actuator in a liquid droplet jetting mode of jetting the liquid droplets from the nozzle and in a warm-up mode of heating the liquid in the pressure chamber without jetting the liquid in the pressure chamber as the liquid droplets from the nozzle, and in the liquid droplet jetting mode, the controller controls the piezoelectric actuator to perform a liquid droplet jetting operation by which volume of the pressure chamber is decreased to a decreased volume smaller than the predetermined volume, and then the volume of the pressure chamber is increased to a increased volume greater than the predetermined volume, and the volume of the pressure chamber is again decreased to the decreased volume; and in the warm-up mode, the controller controls the piezoelectric actuator to perform at least one of a first warm-up operation to change the volume of the pressure chamber repeatedly between the predetermined volume and the increased volume, and a second warm-up operation to change the volume of the pressure chamber repeatedly between the predetermined volume and the decreased volume.

In the warm-up mode, since at least one of the first warm-up operation of changing the volume of the pressure chamber repeatedly to the reference state and the increased volume state alternately, and the second warm-up operation of changing the volume of the pressure chamber repeatedly to the predetermined volume and the decreased volume alternately is performed, it is possible to heat the liquid sufficiently without jetting the liquid inside the pressure chambers. Accordingly, it is possible to avoid an effect of a temperature of the liquid, and to stabilize the jetting performance. Particularly, since a volume change between the predetermined volume and the increased volume (first warm-up operation) and a volume change between the predetermined volume and the decreased volume (second warm-up state) have been used, it is possible to increase an amount of deformation of the piezoelectric actuator, and to heat the liquid, and the heating of the liquid is possible in a short time. Moreover, since the volume of the pressure chamber which stores the liquid and which is in contact with the liquid changes, an efficient heating of the liquid becomes possible.

In the liquid droplet jetting apparatus according to the present invention, the piezoelectric actuator may have a first deformable portion and a second deformable portion, and the first deformable portion and the second deformable portion may be deformed in different directions with each other, and the controller may control the piezoelectric actuator to deform the first deformable portion and the second deformable portion such that the volume of the pressure chamber is changed. In this case, the first deformable portion may correspond to a central portion of the pressure chamber, and the second deformable portion may correspond to outer peripheral portion, of the pressure chamber, outside the central portion. Moreover, the controller may control the piezoelectric actuator to perform the second warm-up operation by deforming the first deformable portion, and to perform the first warm-up operation by deforming the second deformable portion.

The liquid droplet jetting apparatus according to the present invention may further include a manifold extending in an orthogonal direction orthogonal to the predetermined direction and storing the liquid to be supplied to the pressure chamber, and the pressure chamber may be formed as a plurality of pressure chambers arranged in a row in the orthogonal direction and communicating with the manifold; the piezoelectric actuator may have a plurality of deformable portions which correspond to the pressure chambers respectively, and each of which is deformed to perform the liquid droplet jetting operation, and the first warm-up operation and the second warm-up operation; and in the warm-up mode, the controller may control the piezoelectric actuator such that when a deformable portion corresponding to one of two adjacent pressure chambers among the pressure chambers is deformed to perform one of the first warm-up operation and the second warm-up operation, a deformable portion, corresponding to the other pressure chamber of the two adjacent pressure chambers is not deformed and any of the first warm-up operation and the second warm-up operation is not performed. When an entire liquid channel through which the pressure chambers communicate with the manifold are taken into consideration, since the volume of some of the pressure chambers is to be changed only, as a whole, the change in the volume is small, and jetting of the liquid mistakenly is suppressed.

The liquid droplet jetting apparatus according to the present invention may further include a manifold extending in an orthogonal direction orthogonal to the predetermined direction and storing the liquid to be supplied to the pressure chamber, and the pressure chamber may be formed as a plurality of pressure chambers arranged in a row in the orthogonal direction and communicating with the manifold; the piezoelectric actuator may have a plurality of deformable portions which correspond to the pressure chambers respectively, and each of which is deformed to perform the liquid droplet jetting operation, and the first warm-up operation and the second warm-up operation; and in the warm-up mode, the controller may control the piezoelectric actuator such that when a deformable portion, corresponding to one of two adjacent pressure chambers among the pressure chambers is deformed to perform the first warm-up operation, a deformable portion, corresponding to the other pressure chamber of the two adjacent pressure chambers, is deformed to perform the second warm-up operation at a same cycle as a cycle of the first warm-up operation. When an entire liquid channel through which the pressure chambers communicate with the manifold are taken into consideration, since the volume of some of the pressure chambers is changed to be increased and the volume of the rest of the pressure chambers is changed to be decreased, the change in the volume of the some of the pressure chambers and the rest of the pressure chambers is counterbalanced, there is almost no change in the volume as a whole, and jetting of the liquid mistakenly is suppressed.

The liquid droplet jetting apparatus according to the present invention may further include a manifold extending in an orthogonal direction orthogonal to the predetermined direction and storing the liquid to be supplied to the pressure chamber, and the pressure chamber may be formed as a plurality of pressure chambers arranged in two rows in the orthogonal direction and communicating with the manifold, and the piezoelectric actuator may have a plurality of deformable portions which correspond to the pressure chambers respectively, and each of which is deformed to perform the liquid droplet jetting operation, and the first warm-up operation and the second warm-up operation; and in the warm-up mode, the controller may control the piezoelectric actuator such that when deformable portions corresponding to the pressure chambers forming one row of the two rows are deformed to perform one of the first warm-up operation and the second warm-up operation, deformable portions, corresponding to pressure chambers forming the other row of the two rows, are not deformed and any of the first warm-up operation and the second warm-up operation is not performed. When an entire liquid channel through which the pressure chambers communicate with the manifold are taken into consideration, since the volume of the pressure chambers only in one row is changed, the change in volume is small, and the liquid is suppressed from being jetted mistakenly.

The liquid droplet jetting apparatus according to the present invention may further include a manifold extending in an orthogonal direction orthogonal to the predetermined direction and storing the liquid to be supplied to the pressure chamber, and the pressure chamber may be formed as a plurality of pressure chambers arranged in two rows in the orthogonal direction and communicating with the manifold; the piezoelectric actuator may have a plurality of deformable portions which correspond to the pressure chambers respectively, and each of which is deformed to perform the liquid droplet jetting operation, and the first warm-up operation and the second warm-up operation; and in the warm-up mode, the controller may control the piezoelectric actuator such that when deformable portions corresponding to pressure chambers among the plurality of pressure chambers forming one row of the two rows, are deformed to perform the first warm-up operation, a deformable portions, corresponding to pressure chambers forming the other row of the two rows, are deformed to perform the second warm-up operation at a same cycle as a cycle of the first warm-up operation. When an entire liquid channel through which the pressure chambers communicate with the manifold are taken into consideration, since the volume of the pressure chambers in one row is changed to be increased and the volume of the pressure chambers in the other row is changed to be decreased, the change in the volume is counterbalanced for the two rows of pressure chambers, and there is almost no change in the volume as a whole, and the liquid is suppressed from being jetted mistakenly.

The liquid droplet jetting apparatus according to the present invention may further include an electric potential applying mechanism which applies an electric potential to the piezoelectric actuator, and the piezoelectric actuator may have at least two piezoelectric material layers, a first common electrode which is provided between the two piezoelectric material layers, a first individual electrode which is provided on a surface, of one of the piezoelectric material layers, opposite to a surface on which the first common electrode is provided, and a second common electrode which is provided on a surface, of the other of the piezoelectric material layers, opposite to a surface on which the first common electrode is provided; the first common electrode may have a portion facing a central portion, of the pressure chamber, in width direction of the pressure chamber, and the first individual electrode and the second common electrode may have portions which are formed to be longer than the first common electrode in the width direction of the pressure chamber respectively; and in the liquid droplet jetting mode, the controller may control the electric potential applying mechanism to apply to the first individual electrode an electric potential in order of ground electric potential, a positive electric potential, and the ground electric potential, in a state that the positive electric potential is applied to the first common electrode and the second common electrode is at the ground electric potential; and in the warm-up mode, the controller may control the electric potential applying mechanism to apply alternately the positive electric potential and the ground electric potential to the first common electrode in a state that the first individual electrode and the second common electrode are at the ground electric potential, or to apply alternately the positive electric potential and the ground electric potential substantially simultaneously to the first individual electrode and the first common electrode in a state that the second common electrode is at the ground electric potential.

Particularly, in the state of the individual electrode let to be at the ground electric potential, when the positive electric potential is applied and stopped applying repeatedly to the first common electrode, since the individual electrode is let to be at the same electric potential as the first common electrode, no electric field other than an electric field similar to as in the liquid droplet jetting mode is applied to the piezoelectric actuator, and there is no deterioration of the piezoelectric actuator. Moreover, when the positive electric potential is applied and stopped applying repeatedly, almost simultaneously to the first individual electrode and the first common electrode, since it is an application of the electric potential in which the displacement is suppressed, the deformation of the pressure chamber is extremely small, and there is no possibility that the liquid is jetted.

The liquid droplet jetting apparatus according to the present invention may further include an electric potential applying mechanism which applies an electric potential to the piezoelectric actuator, and the piezoelectric actuator may have at least one piezoelectric material layer, a second individual electrode and a third individual electrode which are provided on a side of one surface of the piezoelectric material layer, and a third common electrode which is provided on a side of the other surface of the piezoelectric material layer; the second individual electrode may have a portion facing a central portion of the pressure chamber in a width direction of the pressure chamber; the third individual electrode may be arranged on both sides of the second individual electrode in the width direction of the pressure chamber and the third common electrode may have a portion facing the second and the third individual electrode in the width direction of the pressure chamber; in the liquid droplet jetting mode, the controller may control the electric potential applying mechanism such that a ground electric potential is applied to the third individual electrode and the third common electrode and a positive electric potential is applied to the second individual electrode, and then the ground electric potential is applied to the second individual electrode and the third common electrode and the positive electric potential is applied to the third individual electrode, and then the ground electric potential is again applied to the third individual electrode and the third common electrode and a positive electric potential is again applied to the second individual electrode; and in the warm-up mode, the controller may control the electric potential applying mechanism to alternately apply the positive electric potential and the ground electric potential to one of the second individual electrode and the third individual electrode in a state that the third common electrode is at the ground electric potential. Even in this case, it is possible to realize the warm-up operation reasonably.

The liquid droplet jetting apparatus according to the present invention may further include an electric potential applying mechanism which applies an electric potential to the piezoelectric actuator, and the piezoelectric actuator may have at least one piezoelectric material layer, a fourth individual electrode and a fourth common electrode which are provided on a side of one surface of the piezoelectric material layer, and a fifth common electrode and a sixth common electrode which are provided on a side of the other surface of the piezoelectric material layer; the fourth individual electrode may have a portion facing a central portion, of the pressure chamber, in a width direction of the pressure chamber, and the fourth common electrode may be arranged on both sides of the fourth individual electrode in the width direction of the pressure chamber; and the fifth common electrode and the sixth common electrode may have portions facing the fourth individual electrode and the fourth common electrode, respectively, in the width direction of the pressure chamber; in the liquid droplet jetting mode, the controller may control the electric potential applying mechanism such that a ground electric potential is applied to the fourth individual electrode, the fifth common electrode, and the sixth common electrode and a positive electric potential is applied to the fourth common electrode, then the ground electric potential is applied to the sixth common electrode and a positive electric potential is applied to the fourth individual electrode, the fourth common electrode, and the fifth common electrode, and then the ground electric potential is applied again to the fourth individual electrode, the fifth common electrode, and the sixth common electrode and a positive electric potential is applied again to the fourth common electrode; and in the warm-up mode, the controller may control the electric potential applying mechanism such that application and non-application of the positive electric potential to the fourth common electrode is repeated in a state that the ground electric potential is applied to the fourth individual electrode, the fifth common electrode, and the sixth common electrode, or application and non-application of the positive electric potential to the fourth individual electrode, fourth common electrode, and the fifth common electrode is repeated in a state that the ground electric potential is applied to the sixth common electrode.

In the liquid droplet jetting apparatus according to the present invention, when a time during which a pressure wave is propagated one-way in a liquid channel, of the liquid droplet jetting head, including the pressure chambers is AL, the electric potential applying mechanism may switch between application of the electric potential and non-application of the electric potential at a timing of 2AL. In this case, since the timing of applying the positive electric potential and not applying the electric potential is let to be 2AL, the liquid droplets are not jetted. Only by letting the timing of applying and not applying the positive electric potential to be 2AL, it is possible to suppress further the jetting by lowering further the voltage applied.

In the liquid droplet jetting apparatus according to the present invention, the liquid droplet jetting head may have a temperature detector which detects a temperature corresponding to a temperature of the liquid in the pressure chamber, and the controller may select to perform the warm-up mode only when the temperature of the liquid is not more than a predetermined value. In this case, only when the temperature of the liquid in the pressure chamber is not higher than the set value, by putting a power supply ON, it is shifted to the warm-up mode prior to the liquid droplet jetting mode. The warm-up operation is carried out only when the heating is necessary for the liquid in the pressure chamber, and electric power is saved.

According to a second aspect of the present invention, there is provided a liquid droplet jetting apparatus which jets droplets of a liquid, including a liquid droplet jetting head having a cavity unit in which a pressure chamber extending in a predetermined direction and a nozzle communicating with the pressure chamber are formed, and a piezoelectric actuator which is joined to the cavity unit to cover the pressure chamber, which applies pressure to the liquid in the pressure chamber, and which has first active portion corresponding to a central portion of the pressure chamber, and a second active portion corresponding to outer peripheral portion, of the pressure chamber, outside the central portion; and a voltage applying mechanism which applies a voltage to the piezoelectric actuator in a liquid droplet jetting mode of jetting the liquid droplets from the nozzle and a warm-up mode of heating the liquid inside the pressure chamber without jetting the liquid as liquid droplets from the nozzle, and in the liquid droplet jetting mode, the voltage applying mechanism applies a voltage to the first active portion and does not apply the voltage to the second active portion to provide a first state in which the first active portion is deformed to project toward the pressure chamber, and then the voltage applying mechanism applies the voltage to the second active portion and does not apply the voltage to the first active portion to provide a second state in which the second active portion is deformed to project in a direction away from the pressure chamber, and then the first state is again provided; and in the warm-up mode, the voltage applying mechanism applies the voltage to both the first active portion and the second active portion to provide a third state in which the first active portion is deformed to project toward the pressure chamber and the second active portion is deformed to project in the direction away from the pressure chamber, and then the voltage applying mechanism does not apply any voltage to the first active portion and the second active portion to provide a fourth state in which both the first active portion and the second active portion are not deformed, such that the third state and the fourth state are repeated alternately.

In the warm-up mode, the piezoelectric actuator is driven such that the third state in which the first active portion is deformed to project toward the pressure chamber and the second active portion is deformed to project in a direction away from the pressure chamber by applying the voltage to both the first active portion and the second active portion, and the fourth state in which both the first active portion and the second active portion are not deformed as the voltage is not applied to both the first active portion and the second active portion, are repeated alternately. As a result, the piezoelectric actuator generates heat while letting in a state in which the change in the volume of the pressure chamber does not become substantial, and it is possible to heat without the liquid inside the pressure chamber being jetted, thereby stabilizing a liquid droplet jetting performance. Particularly, since the heat is generated by the piezoelectric actuator near the pressure chambers which accommodate the liquid and which are in contact with the liquid, it is possible to heat the ink efficiently.

In the liquid droplet jetting apparatus according to the present invention, in the warm-up mode, the voltage applying mechanism may apply, to the first active portion and the second active portion, another voltage greater than the voltage applied in the liquid droplet jetting mode, or may make a pulse width of the another voltage applied to the first active portion and the second active portion to be wider than a pulse width of the voltage applied in the liquid droplet jetting mode. In this case, in the warm-up mode, since it is possible to make substantial an amount of deformation of the first active portion and the second active portion (an amount of deformation of the piezoelectric actuator) than an amount of deformation of the first active portion and the second active portion in the liquid droplet jetting mode, it is possible to carry out efficiently the heating of the liquid in the pressure chamber.

In the liquid droplet jetting apparatus according to the present invention, the piezoelectric actuator may have at least one piezoelectric material layer, a first individual electrode and a second individual electrode which are provided on a side of one surface of the piezoelectric material layer, and a first common electrode which is provided on a side of the other surface of the piezoelectric material layer; the first individual electrode may have a portion corresponding to a central portion, of the pressure chamber, in a width direction of the pressure chamber, and the second individual electrode may have a portion corresponding to both side portions in the width direction of the pressure chamber, the first common electrode may have a portion corresponding to the first individual electrode and the second individual electrode in the width direction of the pressure chamber, a first active portion may be formed in a portion, of the piezoelectric material layer, sandwiched between the first individual electrode and the first common electrode, and a second active portion may be formed in a portion, of the piezoelectric material layer, sandwiched between the second individual electrode and the first common electrode; and in the liquid droplet jetting mode, the voltage applying mechanism may apply voltage to the piezoelectric actuator such that a ground electric potential is applied to the first common electrode and the second individual electrode and a positive electric potential is applied to the first individual electrode, and then the ground electric potential is applied to the first individual electrode and the first common electrode and a positive electric potential is applied to the second common electrode, and the ground electric potential is applied again to the first common electrode and the second individual electrode and the positive electric potential is applied again to the first individual electrode, and in the warm-up mode, the voltage applying mechanism may apply alternately the positive electric potential and the ground electric potential to the first individual electrode and the second individual electrode in a state that the ground electric potential is applied to the first common electrode. In this case, since in the warm-up mode, since the positive electric potential and the ground electric potential are applied to the first individual electrode and the second individual electrode in the state of the first common electrode let to be at the ground electric potential, the piezoelectric actuator is driven such that the change in the volume of the pressure chamber does not become substantial, and the liquid in the pressure chamber is heated by the heat generated by the piezoelectric actuator.

In the liquid droplet jetting apparatus according to the present invention, the piezoelectric actuator may have at least one piezoelectric material layer, a third individual electrode and a second common electrode which are provided on a side of one surface of the piezoelectric material layer, and a third common electrode and a fourth common electrode which are provided on a side of the other surface of the piezoelectric material layer; and the third individual electrode may have a portion corresponding to a central portion, of the pressure chamber, in a width direction of the pressure chamber; and the second common electrode may have a portion corresponding to both side portions in the width direction of the pressure chamber; and the third common electrode and the fourth common electrode may have portions corresponding to the second common electrode and the third individual electrode respectively, in the width direction of the pressure chamber; and a first active portion may be formed in a portion, of the piezoelectric material layer, sandwiched between the third individual electrode and the third common electrode; and a second active portion may be formed in a portion, of the piezoelectric material layer, sandwiched between the second common electrode and the fourth common electrode; and in the liquid droplet jetting mode, the voltage applying mechanism may apply voltage to the piezoelectric actuator such that a ground electric potential is applied to the fourth common electrode and a positive electric potential is applied to the third individual electrode, the second common electrode and the third common electrode, then the ground electric potential is applied to the third individual electrode, the third common electrode and the fourth common electrode and a positive electric potential is applied to the second common electrode, and the ground electric potential is applied again to the fourth common electrode and the positive electric potential is applied again to the third individual electrode, the second common electrode, and the third common electrode; and in the warm-up mode, the voltage applying mechanism may repeat application and non-application of the positive electric potential to the third individual electrode and the second common electrode in a state that the ground electric potential is applied to the third common electrode and the fourth common electrode. In this case, in the warm-up mode, since applying and not applying the positive electric potential to the third individual electrode and the second common electrode is repeated in the state of the third common electrode and the fourth common electrode let to be at the ground electric potential, the piezoelectric actuator is driven such that the change in the volume of the pressure chamber does not become substantial, and the liquid in the pressure chamber is heated by the heat generated by the piezoelectric actuator.

In the liquid droplet jetting apparatus according to the present invention, when a time during which a pressure wave is propagated one-way in a liquid channel, of the liquid droplet jetting head, including the pressure chambers is AL, the electric potential applying mechanism may switch between application of the electric potential and non-application of the electric potential at a timing of 2AL.

In the liquid droplet jetting apparatus according to the present invention, the liquid droplet jetting head may have a temperature detector which detects a temperature corresponding to a temperature of the liquid in the pressure chamber, and the voltage applying mechanism may select to perform the warm-up mode only when the temperature of the liquid is not more than a set value.

DETAILED DESCRIPTION OF THE PREFERRED EMBODIMENTS

Exemplary embodiments of the present invention will be described below by referring to the accompanying diagrams.

Figure 1A:
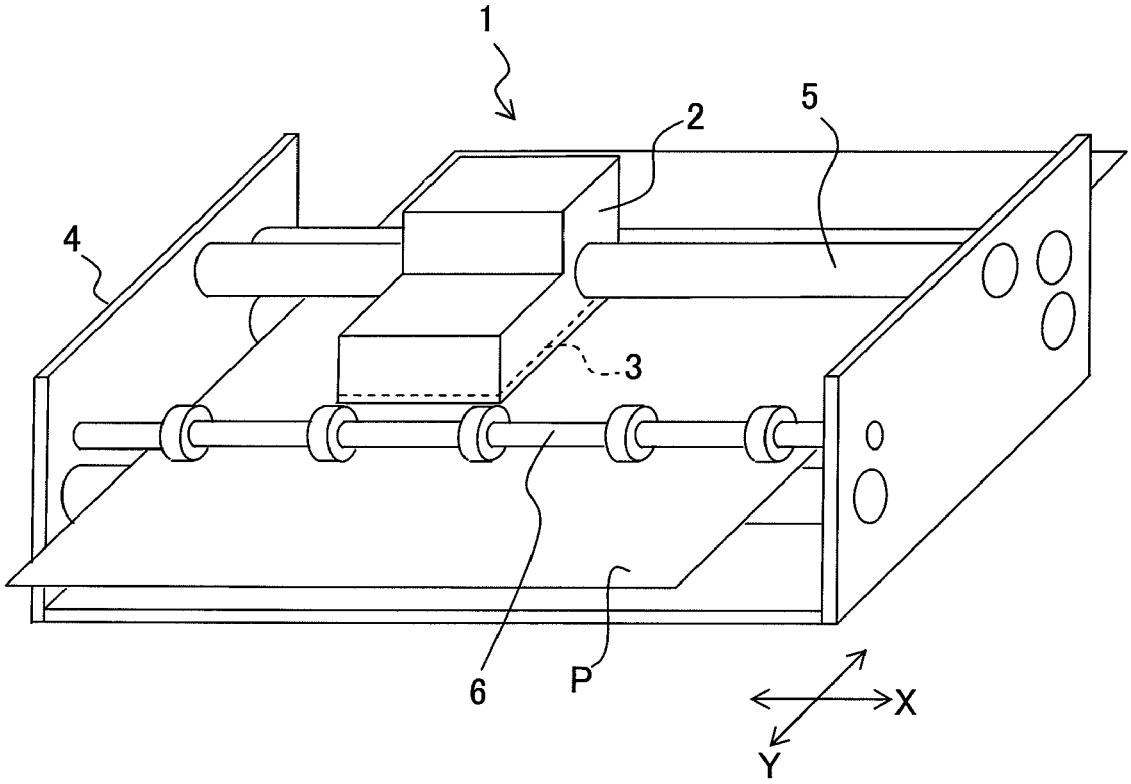
FIG. 1A is a schematic structural view showing a schematic structure of an ink-jet printer according to the present invention.

To start with, a first embodiment of the present invention will be described below. FIG. 1A is a schematic structural view showing a schematic structure of an ink-jet printer according to the present invention, and FIG. 1B is an explanatory diagram showing a relation of a cavity unit, a piezoelectric actuator, and a flexible cable (COP) according to the present invention;

An ink-jet printer 1 according to the present invention, as shown in FIG. 1A, is provided with an ink-jet printer head 3 (liquid droplet jetting head) for recording an image etc. on a recording paper P (recording medium), on a lower surface of a carriage 2 on which ink cartridges (not shown in the diagram) are mounted. The carriage 2 is supported by a guide plate (not shown in the diagram) and a carriage shaft 5 provided inside a printer frame 4, and reciprocates in a direction (hereinafter called as "X-direction") orthogonal to a direction of transporting of the recording paper P (hereinafter called as "Y-direction").

The recording paper P which is transported in direction A from a paper feeding section which is not shown in the diagram is inserted between a platen roller (not shown in the diagram) and the printer head 3, and is discharged by a discharge roller 6 upon a predetermined recording being carried out by an ink jetted from the printer head 3 toward the recording paper P.

Figure 1B:
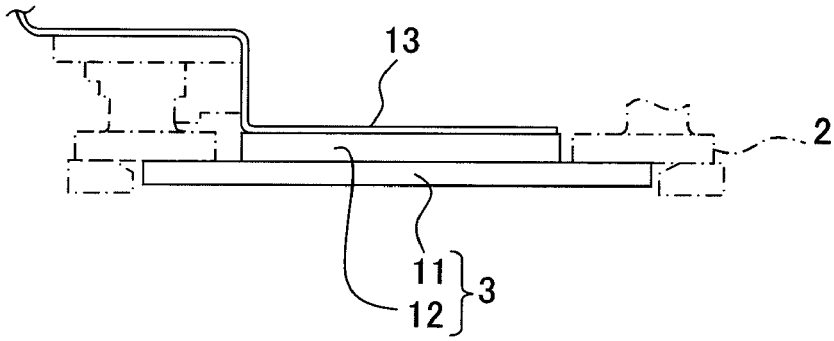
FIG. 1B is an explanatory diagram showing a relationship of a cavity unit, a piezoelectric actuator, and a flexible cable (COP) according to the present invention.
Figure 2A:
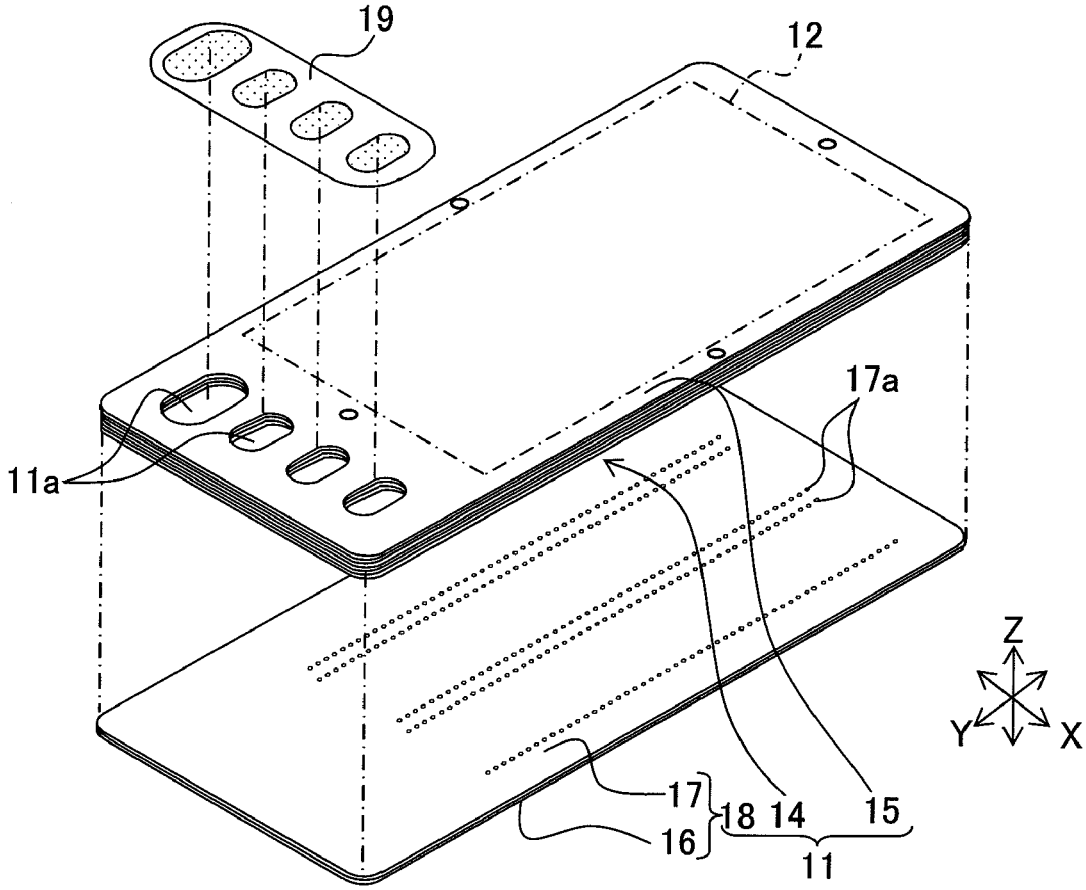
FIG. 2A is a perspective view showing a state in which, the piezoelectric actuator is stuck to an upper side of the cavity unit.
Figure 2B:
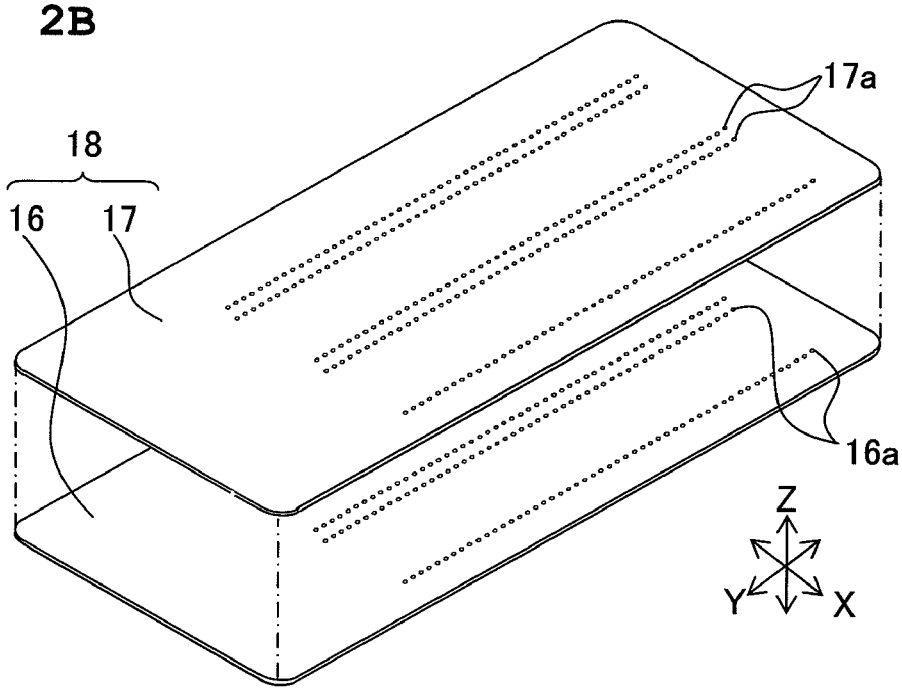
FIG. 2B is an explanatory diagram of a plate assembly which is made by sticking a nozzle plate and a spacer plate.

Moreover, as shown in FIG. 1B and FIG. 2, the printer head 3 includes a cavity unit 11 and a piezoelectric actuator 12 in order from a lower side, and a flexible cable 13 (signal wire) which supplies a drive signal is provided to an upper surface side of the piezoelectric actuator 12.

The cavity unit 11 includes a stacked body 14 formed by stacking a plurality of plates (plate materials) having an opening. At an upper side of the stacked body 14, a vibration plate 15 is provided, and at a lower side thereof, a plate assembly 18 which is formed by stacking a nozzle plate 16 having nozzles 16*a* and a spacer plate 17 having through holes 7*a* corresponding to the nozzles 16*a*, is stuck integrally. The piezoelectric actuator 12 is provided at an upper side of the vibration plate 15 (refer to FIG. 1B). Here, the vibration plate 15, as it is shown in FIG. 4C which will be described later, is formed by a metal plate portion 15 which blocks a pressure chamber 40, and an insulating layer 15*b* which is stacked on an upper side thereof. In other words, the insulating layer 15*b* and the piezoelectric actuator 12 are stacked on the upper side of the metal plate portion 15*a*. A surface of the vibration plate 15 toward the piezoelectric actuator 12 (piezoelectric material layer 12B) may be a surface having an insulating property, or a vibration plate which is entirely made of a synthetic resin may be used.

Moreover, as shown in FIG. 2A, a filter 19 for trapping dust etc. in the ink is provided in an opening 11*a* of the cavity unit 11. The nozzle plate 16 is a high-molecular synthetic resin (such as polyimide) plate in which the plurality of nozzles 16*a* which communicate with the plurality of pressure chambers 40 respectively formed in the cavity plate 14A which will be described later (forming a stacked body 14) are formed. The nozzles 16*a* are formed in the high-molecular synthetic resin plate by an excimer laser machining.

Figure 3A:
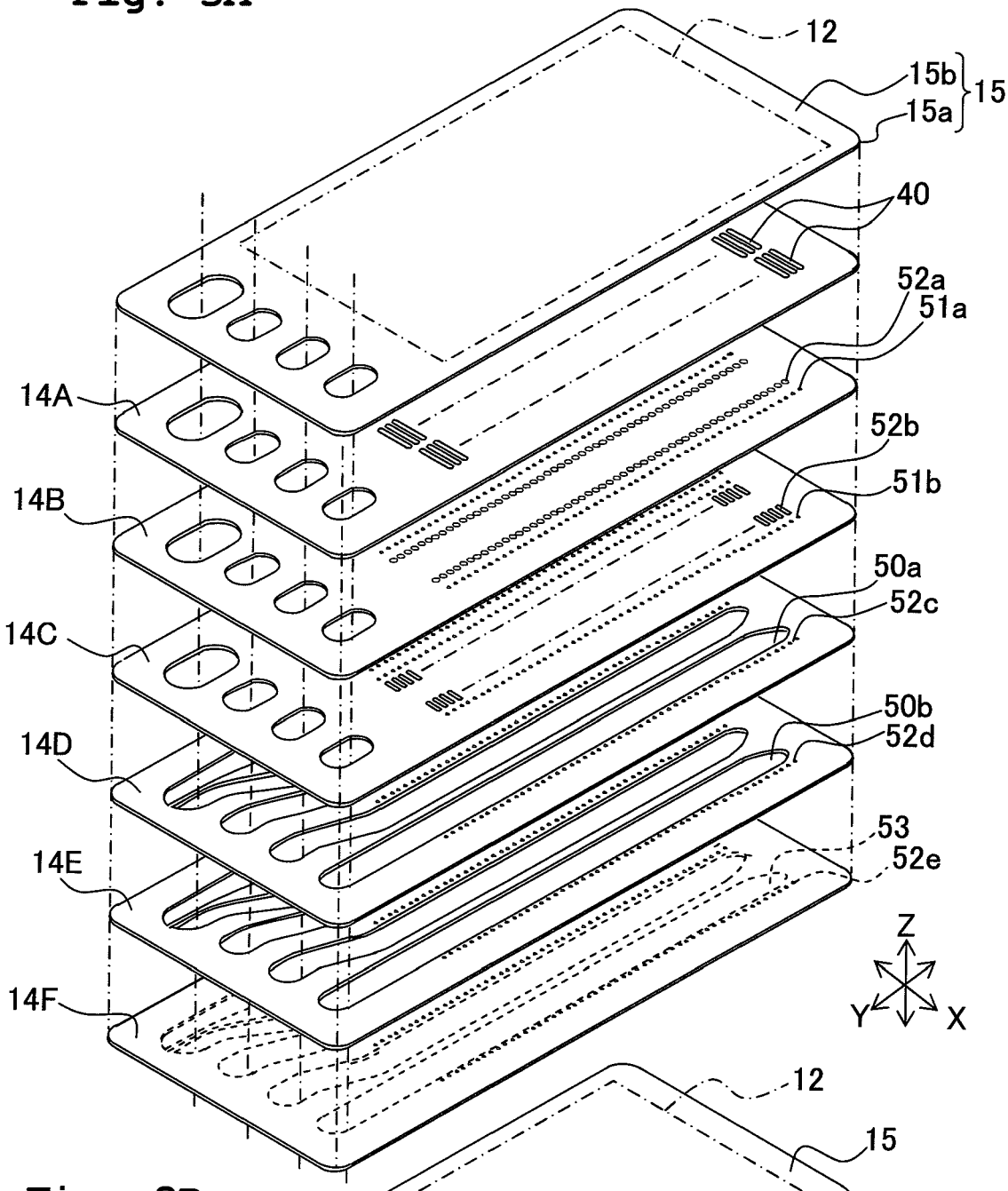
FIG. 3A is diagram showing a cavity plate disassembled to each plate which is a component of the cavity plate, with vibrations.
Figure 3B:
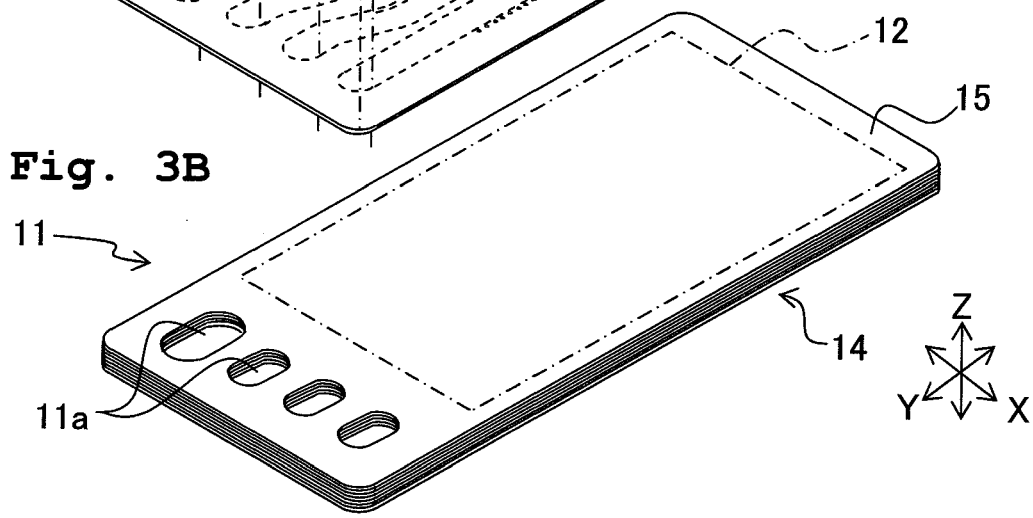
FIG. 3B is a diagram of a joined state.

The stacked body 14, as shown in FIG. 3, includes the cavity plate 14A, a base plate 14B, an aperture plate 14C, two manifold plates 14D and 14E, and a damper plate 14F (plates 14A to 14F), which are stacked in this order. These six plates 14A to 14F are stacked upon positioning such that an ink channel is formed individually for each nozzle 16*a*, and are fixed by metal diffusion joining. The vibration plate 15 is further stacked on the stacked body 14 and joined by the metal diffusion joining. A direction in which these six plates are stacked will be called as a "Z-direction" in the following description.

The ink channels formed in the cavity unit 11 are formed by openings in the plates 14A to 14F, 16, and 17, and the ink flowing through the ink channels is jetted from the nozzle 16*a* of the printer head 3.

The cavity plate 14A is a rectangular metal plate with a longer side of the rectangle in Y-direction, and a plurality of cavities which become the pressure chambers 40 are formed therein. The pressure chambers 40 (cavities) are formed as through holes in the cavity plate 14A by an etching. The pressure chambers 40 form a plurality of pressure chamber rows, and each extending in Y-direction. Moreover, the pressure chamber rows are lined up in X-direction. The vibration plate 15 is stacked on an upper surface side of the cavity plate 14A to cover the pressure chambers 40 (cavities).

The base plate 14B is a metal plate in which a communicating hole 52*a* from manifold 50 (common ink chambers) to each pressure chamber 40, and a communicating hole 51*a* from each pressure chamber 40 to each nozzle 16*a* are formed. The aperture plate 14C is a metal plate in which, a communicating hole 52*b* which makes each pressure chamber 40 communicate with the manifold 50, and a communicating hole 51*b* from each pressure chamber 40 to the nozzle 16*a* are formed as a recess channel on an upper surface side thereof. The manifold plates 14D and 14E are metal plates in which, communicating holes 52*c* and 52*d* from each pressure chamber 40 to each nozzle 16*a* are formed in addition to through holes 50*a* and 50*b* which form the manifold 50. The damper plate 14F is a metal plate in which, a communicating hole 52*e* which makes communicate each pressure chamber 40 and each nozzle 16*a*, apart from a damper chamber 53 formed as a recess in a lower surface side thereof.

Figure 4A:
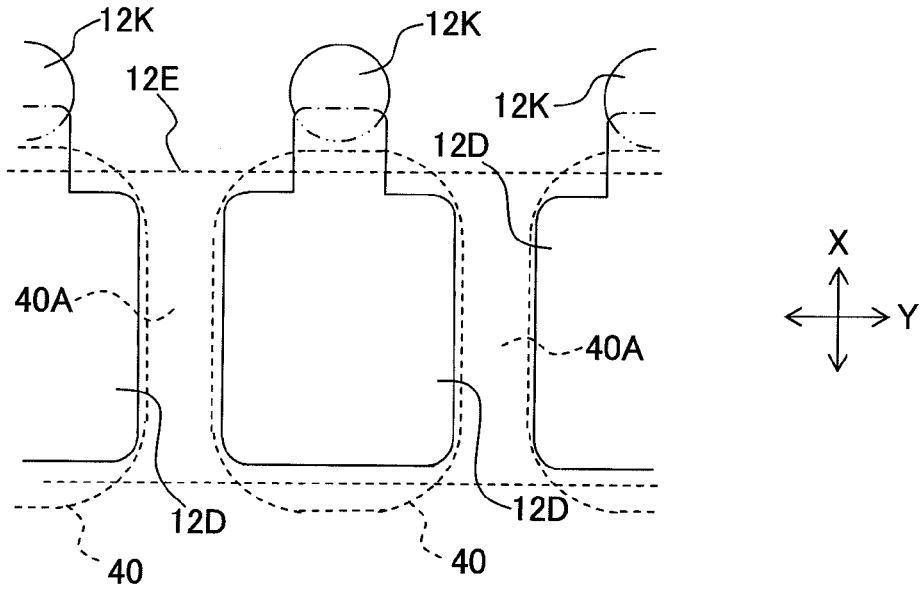
FIG. 4A is a diagram showing an arrangement at an upper-surface side of a piezoelectric material layer on an upper-surface side.
Figure 4B:
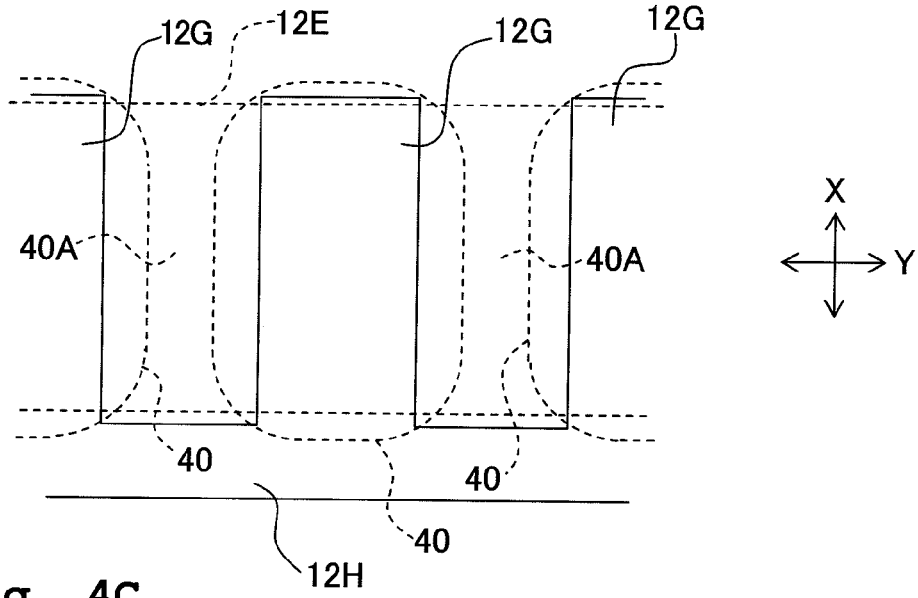
FIG. 4B is a diagram showing an arrangement of an electrode on a lower-surface side of the piezoelectric material layer.
Figure 4C:
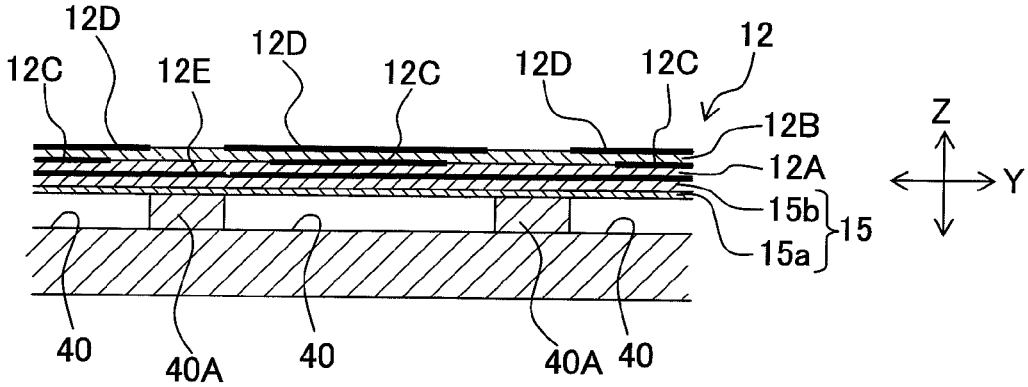
FIG. 4C is a cross-sectional view.
Figure 5:
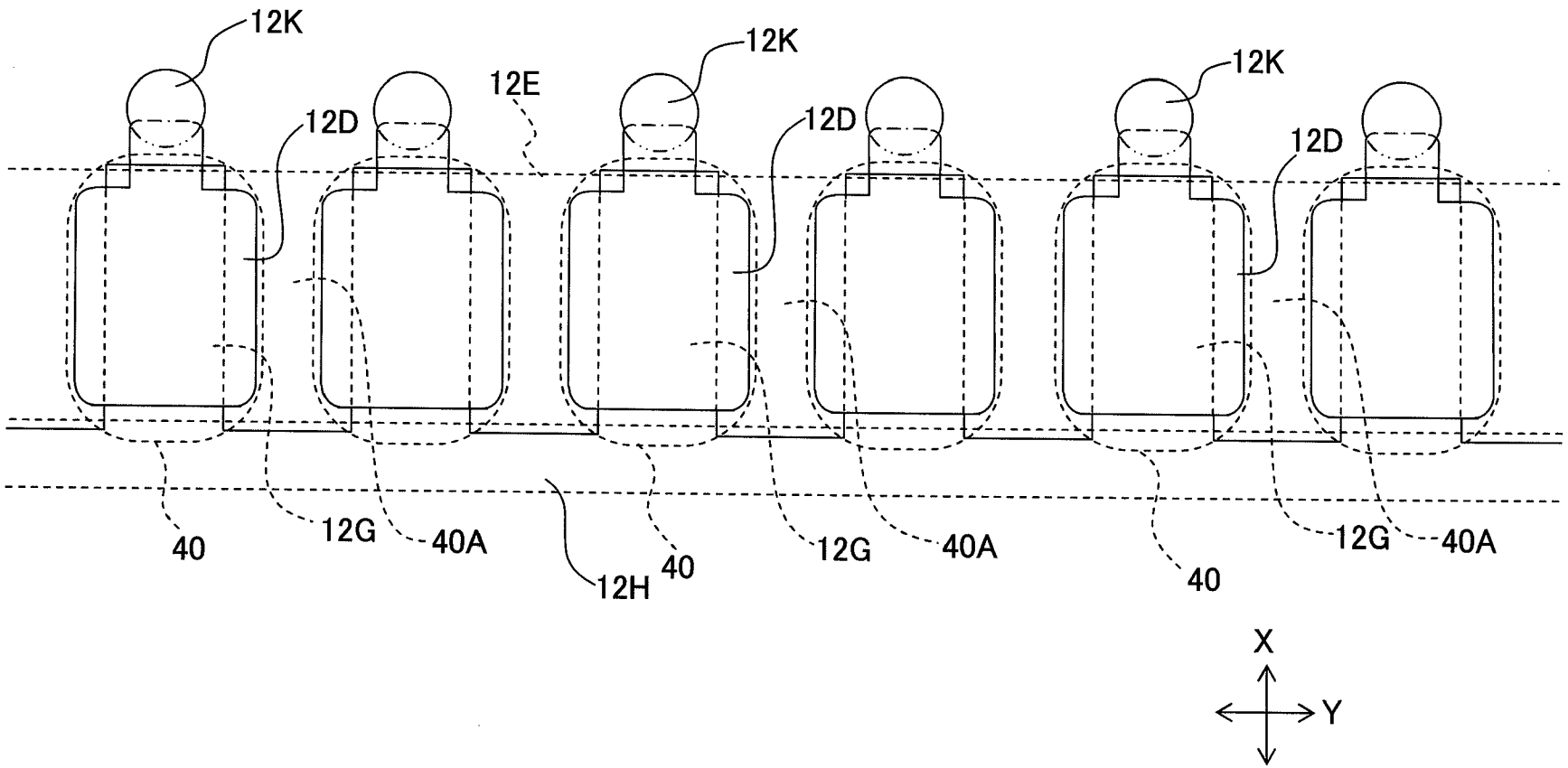
FIG. 5 is an explanatory diagram of an electrode arrangement when the electrode is seen in a plan view.

As shown in FIG. 4C, the piezoelectric actuator 12 has two piezoelectric material layers 12A and 12B formed on the vibration plate 15, and a first common electrode 12C is formed between the piezoelectric material layers 12A and 12B. A first individual electrode 12D is formed on a surface of one piezoelectric material layer 12B, on an opposite side of a surface on which the first common electrode 12C is formed, and a second common electrode 12E is formed on a surface of the other piezoelectric material layer 12A, on an opposite side of a surface on which the first common electrode 12C is formed. When viewed in Z-direction, the first common electrode 12C, as shown in FIG. 4B and FIG. 5, has a first portion 12G extending in a longitudinal direction of the pressure chamber 40 (X-direction), corresponding to a central portion in a width direction of the pressure chamber (Y-direction) and a second portion 12H extending in Y-direction which is connected to the first portion 12G at one end side in X-direction. The first common electrode 12C is formed to be comb-teeth shaped.

As shown in FIG. 4A and FIG. 5, the first individual electrode 12D is formed corresponding to each pressure chamber 40. A connecting terminal portion 12K is formed on the first common electrode 12C, on an opposite side (the other end side in X-direction) of the side on which the second portion 12H is formed, in an area outside an area corresponding to the pressure chamber 40. The second common electrode 12E, as shown in FIG. 4A to FIG. 4C, and FIG. 5, is formed to extend in Y-direction. Moreover, the first individual electrode 12D and the second common electrode 12E have a portion formed to be longer than the first common electrode 12C, in Y-direction.

The piezoelectric material layers 12A and 12B are made of a ceramic material of lead zirconium titanate (PZT) which is a ferroelectric substance, and is polarized in Z-direction as it will be described later. The first individual electrode 12D (including a connecting terminal portion 12K of the first individual electrode 12D) and the first common electrodes 12C and the second common electrode 12E are formed of a metallic material of Ag—Pd. The first individual electrode 12D, the first common electrode 12C, and the second common electrode 12E are connected to a driving circuit 49 (an electric potential applying mechanism, a voltage applying mechanism) which will be described later, by a signal wire of the flexible cable 13 to which the drive signal is supplied, and a driving voltage is selectively supplied from the driving circuit 49 to each first individual electrode 12D, and the first common electrodes 12C and the second common electrodes 12E.

Figure 6:
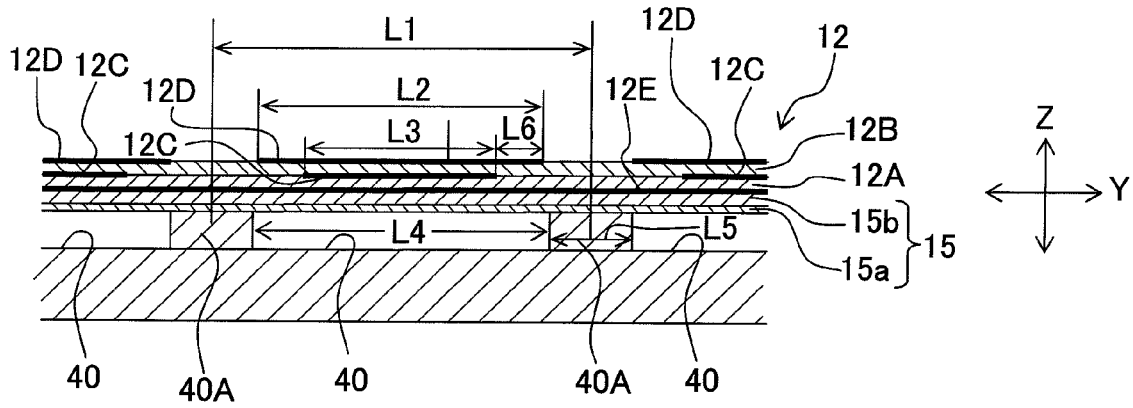
FIG. 6 is an explanatory diagram showing an example of dimensions of the electrode arrangement.
Figure 7:
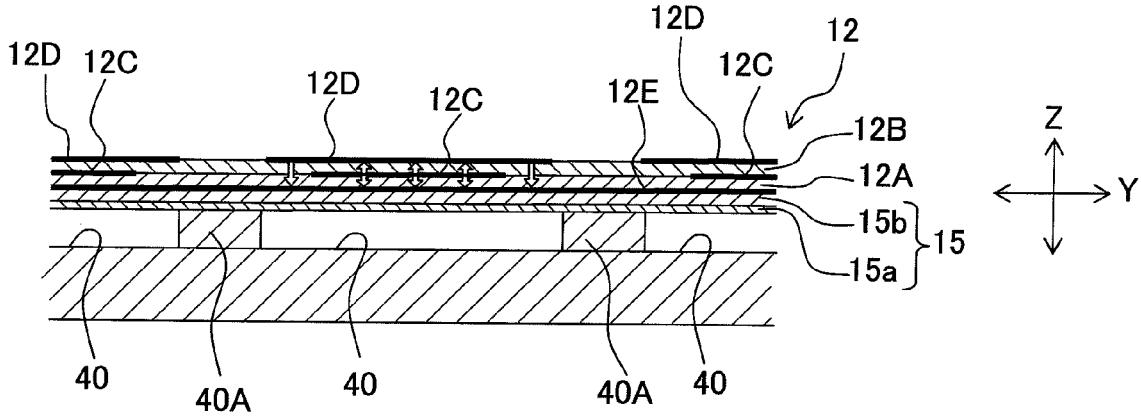
FIG. 7 is an explanatory diagram of polarization.

As shown in FIG. 6, a length L1 from a center to center in Y-direction of two column portions 40A positioned at two sides in the direction of width (Y-direction) of each pressure chamber 40 is approximately 0.5 mm. Moreover, in Y-direction, a length L2 of the first individual electrode 12D is approximately 0.38 mm, and a length L3 of the first common electrode 12C is approximately 0.25 mm. A width L4 of each pressure chamber 40 is approximately 0.4 mm, and a length L5 in Y-direction of the column portions 40A demarcating each pressure chamber 40 is approximately 0.1 mm. Each portion of the piezoelectric material layers 12A and 12B corresponding to both sides in the width direction of each pressure chamber 40 is sandwiched by the first individual electrode 12D and the second common electrode 12E. A length L6 in Y-direction of these portions is approximately 0.065 mm. These portions, as shown in FIG. 7, are polarized in a direction same as a direction of a voltage applied when a positive electric potential is applied to the first individual electrode 12D, and the second common electrode 14E is let to be at the ground electric potential. Moreover, a portion of the piezoelectric material layer 12B, corresponding to the central portion in the width direction of each pressure chamber 40, and sandwiched between the first individual electrode 12D and the first common electrode 12C is polarized in a direction same as a direction of a voltage when the positive electric potential is applied to the first common electrode 12C, and the first individual electrode 12D is let to be at the ground electric potential. Furthermore, a portion of the piezoelectric material layer 12A, corresponding to the central portion in the width direction of each pressure chamber 40, and sandwiched between the first common electrode 12C and the second common electrode 12E, is polarized in a direction same as a direction of voltage applied when the positive electric potential is applied to the first common electrode 12C and the second common electrode 12E is let to be at the ground electric potential.

Figure 8:
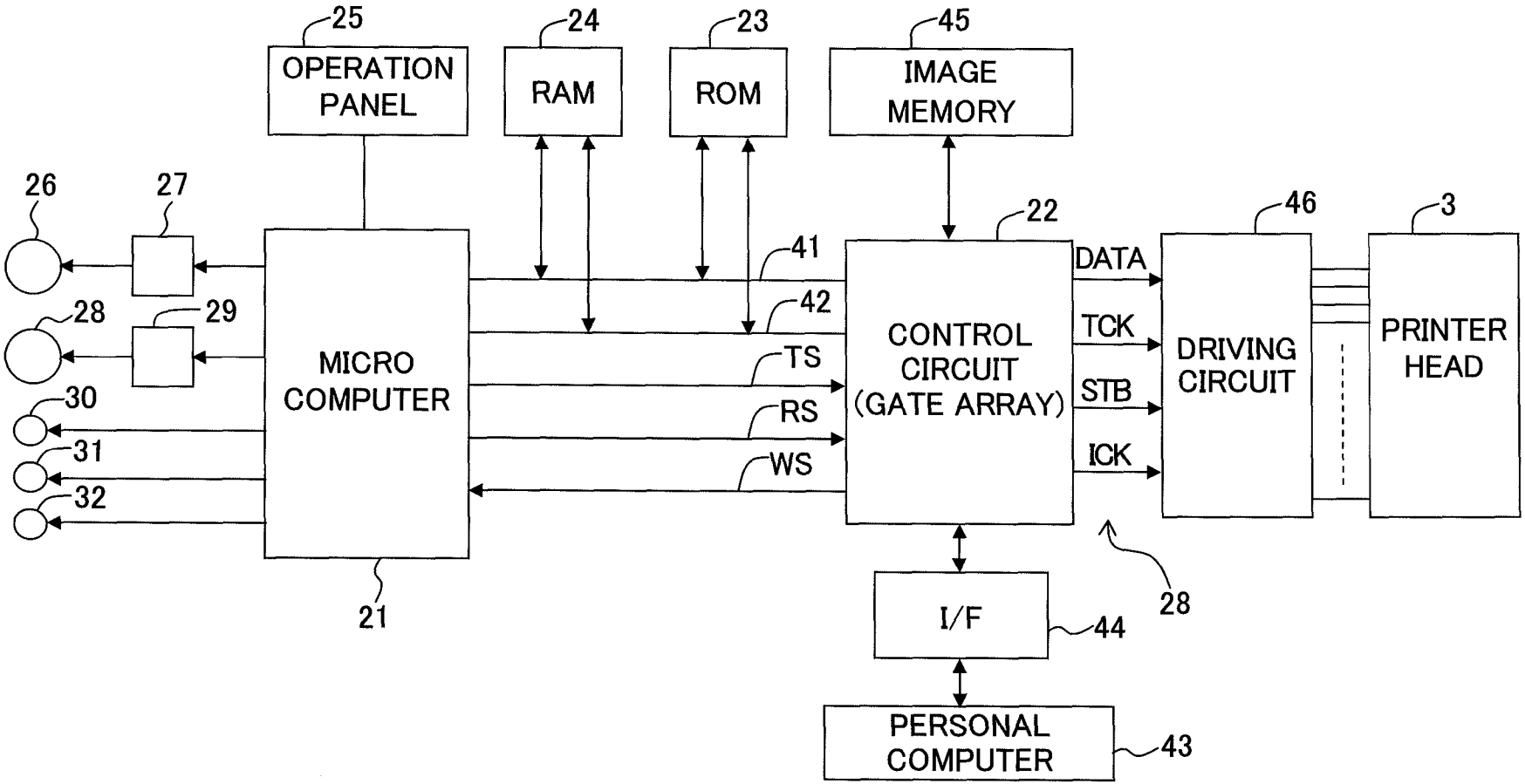
FIG. 8 is a block diagram showing an electrical control system of an ink-jet printer.

Next, an electrical structure of the ink-jet printer 1 will be described below by referring to FIG. 8 and FIG. 9. As shown in FIG. 8, a control unit of the ink-jet printer 1 includes a CPU (central processing unit) (1-chip micro computer) which controls each section of the entire ink-jet printer 1, a control circuit 22 which is a gate circuit LSI, a ROM 23 in which control programs and driving waveform data for jetting various inks are stored, and a RAM 24 which temporarily stores data.

The CPU 21, is connected to an operation panel 25 for inputting various commands, a motor driver 27 which drives a carriage motor 26 which makes reciprocate the carriage 2, and a motor driver 29 which drives a transporting motor 28 which drives a transporting unit. Furthermore, the CPU 21 is connected to (sensors such as) a paper sensor 30 which checks as to whether or not there is a recording paper P, an origin sensor 31 which checks that the printer head 3 is at an origin position, and an ink cartridge sensor 32 which detects a state of an ink cartridge (not shown in the diagram) being mounted correctly.

The CPU 21, the ROM 23, the RAM 24, and the control circuit 22 are connected via an address bus 41 and a data bus 42. Moreover, the CPU 21, in accordance with a computer program stored in the ROM 23 in advance, generate a recording timing signal TS and a control signal RS, and transfers each of the TS and RS to the control circuit 22. The control circuit 22 stores in an image memory 45, recording data which is transferred from an external equipment (device) such as a personal computer 43 via an interface 44. Further, the control circuit 22 generates a reception interrupt signal WS from the data which is transferred from the personal computer 43 via the interface 44, and transfers a signal WS to the CPU 21. The control circuit 22, in accordance with the recording timing signal TS and the control signal RS, and based on the recording data stored in the image memory 45, generates a recording-data signal DATA for forming the recording data on the recording paper P, a transfer clock TCK which is synchronized with the recording-data signal DATA, a strobe signal STB, and a drive signal ICK, and transfers each of the signals DATA, TCK, STB, ICK to the driving circuit 46.

Figure 9:
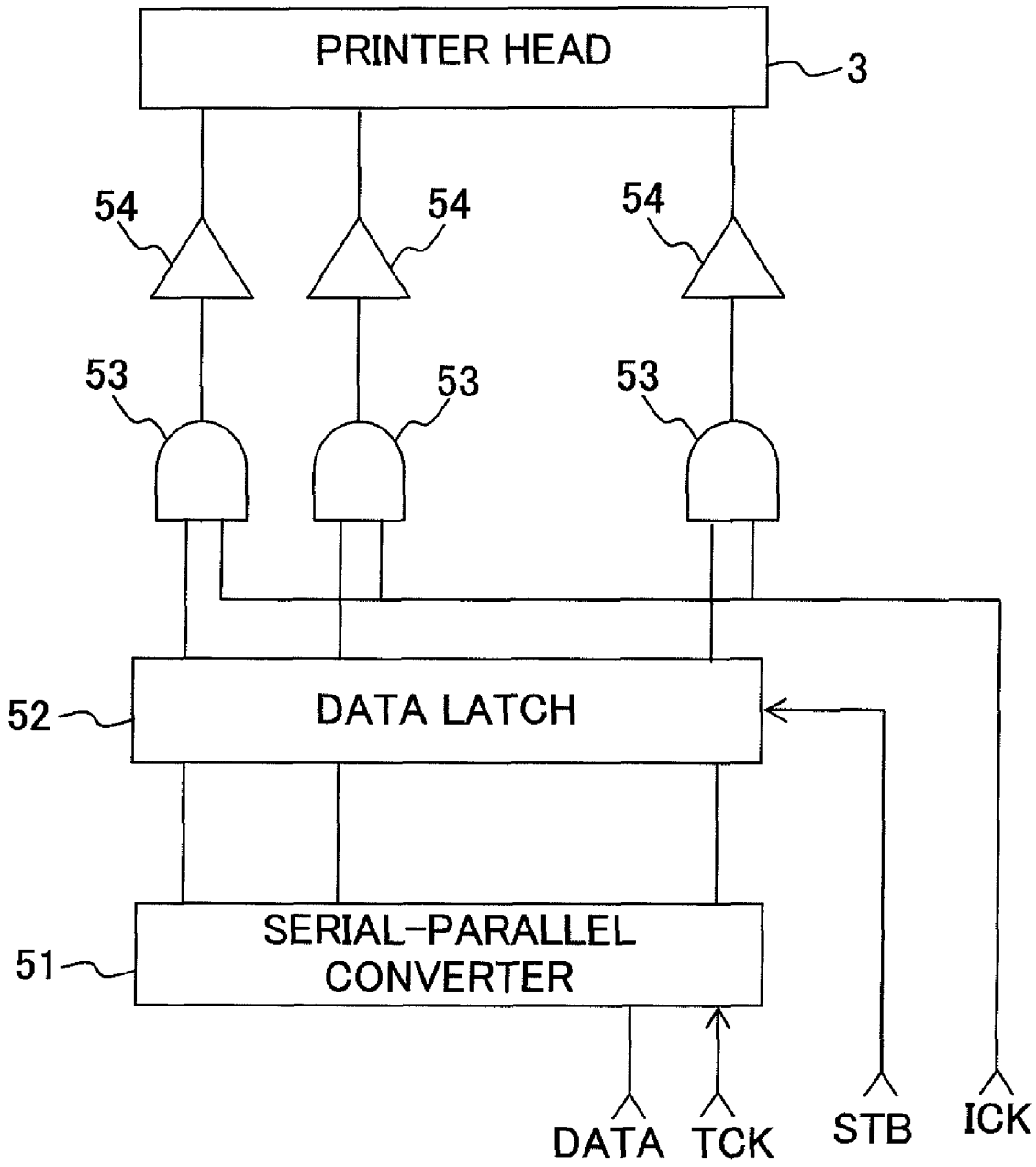
FIG. 9 is an explanatory diagram of an internal structure of a driving circuit.

FIG. 9 is a diagram showing an internal structure of the driving circuit 46. The driving circuit 46 includes a serial-parallel converter 51 which converts the recording-data signal DATA transferred serially in synchronization with the transfer clock signal TCK from a data transfer section (not shown in the diagram) of the control circuit 22, to parallel data, a data latch 52 which latches the converted parallel data DATA based on the strobe signal STB, an AND gate 53 which selectively outputs the drive signal ICK based on the parallel data DATA, and a driver 54 which converts the drive signal which has been output to a predetermined voltage, and outputs as a drive pulse. The drive pulse output from the driver 54 is applied to the individual electrode 12D, and the first common electrode 12C and the second common electrode 12E of the printer head 3, and deforms the piezoelectric material layers 12A and 12B. The number of serial-parallel converters 51, the data latches 52, the AND gates 53, and the drivers 54 is prepared in accordance with the number of nozzles of the printer head 3. The drive signals ICK are stored in the ROM 23, and are read selectively based on the computer program control.

Next, a driving operation at the time of driving the printer head 3 controlled by the control unit (control circuit 22) will be described below.

In an ink jetting mode in which the ink is jetted from the nozzle 16*a*, in a state of the positive electric potential applied to the first common electrode 12C all the time and the ground electric potential applied to the second common electrode 12E all the time, an electric potential (to be) applied to the first individual electrode 12D is changed.

Figure 10A:
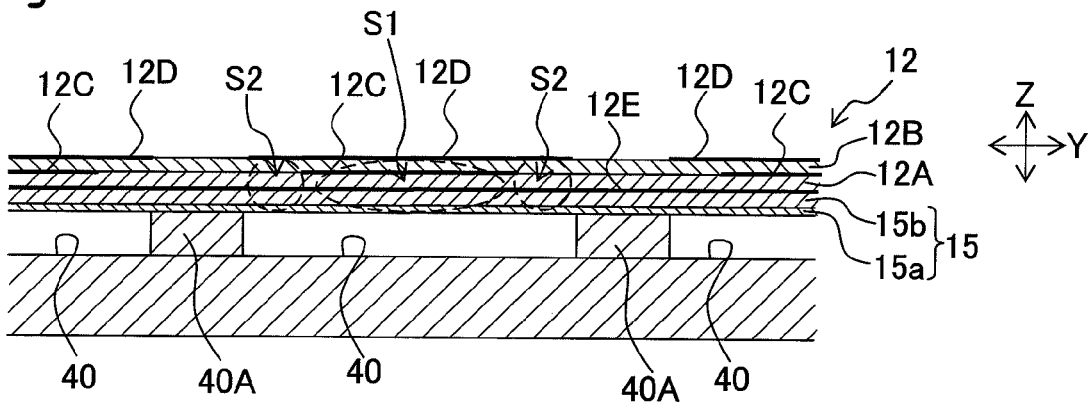
FIG. 10A, FIG. 10B, FIG. 10C, and FIG. 10D are explanatory diagrams showing deformed states respectively.
Figure 10B:
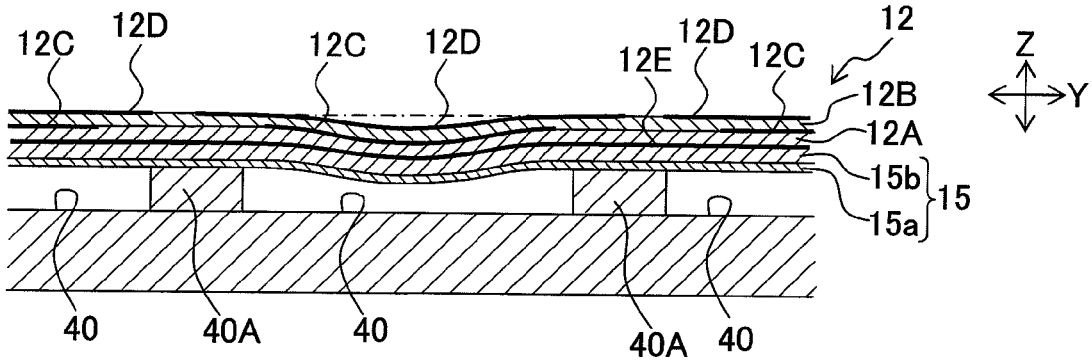

FIG. 10A shows a state in which an electric potential is not applied to any of the electrodes, or a state in which all the electrode are let to be at the ground electric potential. In this state, the piezoelectric material layers 12A and 12B are not deformed, and a volume of the pressure chamber 40 is not changed. A state in which the volume of the pressure chamber 40 is not changed, namely, the volume of the pressure chamber 40 is a predetermined volume is called as a "reference state" in the following description. Next, in a state in which the first individual electrode 12D and the second common electrode 12E are let to be at the ground electric potential, when a positive electric potential is applied to the first common electrode 12C, a portion (a first active portion) of the piezoelectric material layer 12B sandwiched between the first individual electrode 12D and the first common electrode 12C is contracted in a planar direction, and the vibration plate 15 undergoes a unimorph deformation to form a projection toward the pressure chamber 40. In other words, a deformable portion (first deformable portion) S1 of the piezoelectric actuator 12 corresponding to the central portion in the width direction of the pressure chamber 40 is deformed in a direction toward the pressure chamber 40. Accordingly, the pressure chamber 40, as shown in FIG. 10B changes to a state in which the volume is decreased to be less than the volume in the reference state (hereinafter called as a "decreased volume state") shown in FIG. 10B. The piezoelectric actuator 12 lets the pressure chamber 40 to be in the decreased volume state, and waits for a printing command.

Figure 10C:
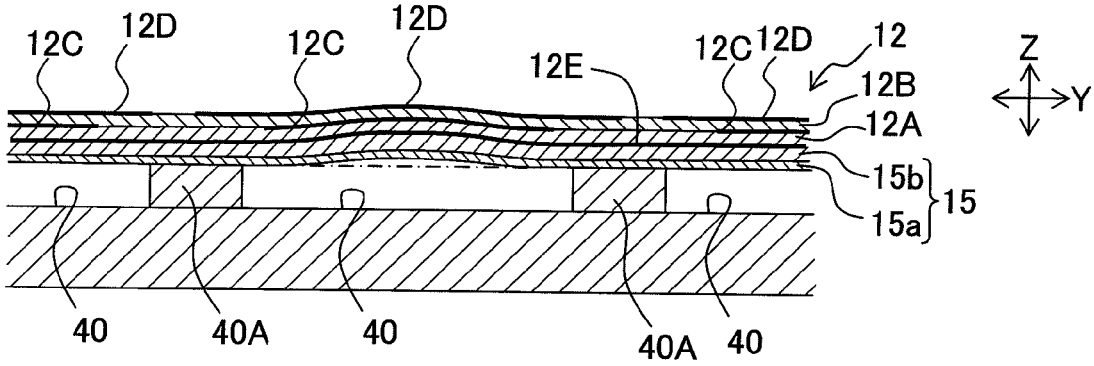
Figure 10D:
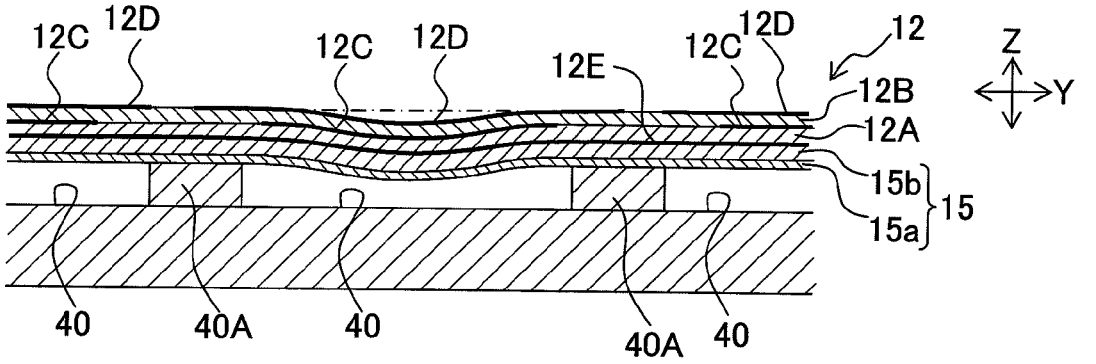

Next, when the positive electric potential is applied to the first individual electrode 12D while maintaining the first common electrode 12C at the positive electric potential and the second common electrode 12E at the ground electric potential, a portion of the piezoelectric material layer 12B sandwiched between the first individual electrode 12D and the first common electrode 12C is not deformed. Whereas, a portion (second active portion) of the piezoelectric material layers 12A and 12B sandwiched between the first individual electrode 12D and the second common electrode 12E contract in a planar direction thereof. Accordingly, the vibration plate 15 undergoes the unimorph deformation to form a projection in a direction away from the pressure chamber 40. In other words, a deformable portion (second deformable portion) S2 of the piezoelectric actuator 12 corresponding to a portion on an outer peripheral side of the central portion in the width direction of the pressure chamber 40 is deformed in a direction away from the pressure chamber 40. As a result, the pressure chamber 40 changes the state from a decreased volume state as shown in FIG. 10B to a state in which the volume of the pressure chamber 40 is increased to be greater than the volume in the reference state (hereinafter, called as an "increased volume state") as shown in FIG. 10C. Accordingly, a negative pressure wave is generated in the ink in the pressure chamber 40. When the first individual electrode 12D is let to be at the ground electric potential once again at a timing when the negative pressure wave is changed to positive upon elapsing of a time (AL) for one-way propagation, the pressure chamber 40 changes the state from the increased volume state shown in FIG. 10C to a decreased volume state shown in FIG. 10D. As the state of the pressure chamber 40 is changed to the decreased volume state, a further positive pressure is superimposed on the ink having the pressure wave changed to positive, and the pressure on the ink becomes even higher and the ink is jetted from the nozzle 16*a*. This is a so-called pulling ejection which is a method for driving the printer head 3.

Although it is not shown in the diagram concretely, the printer head 3 is provided with a temperature detector which detects a temperature corresponding to a temperature of the ink in each pressure chamber 40. A temperature signal from the temperature detector is input to the CPU 21, and according to a judgment at the CPU 21, only when the temperature of the ink is judged to be not higher than a set value, a warm-up mode which will be described below is selected.

For stabilizing the jetting performance irrespective of a use of environment of the ink-jet printer 1, in the warm-up mode of heating the ink inside the pressure chamber 40 without jetting the ink from the nozzles 16*a*, by applying the positive electric potential and the ground electric potential alternately to the first common electrode 12C in a state of the first individual electrode 12D and the second common electrode 12E let to be at the ground electric potential, the piezoelectric material layers 12A and 12B, and the vibration plate 15 of piezoelectric actuator 12 are deformed. By driving the piezoelectric actuator 12 in such manner, and making the piezoelectric actuator 12 generate heat, the ink inside the pressure chamber 40 is heated (second warm-up operation). When the time for one-way propagation of the pressure wave inside the ink channels of the printer head 3 including the pressure chambers 40 is let to be AL, by the driving circuit 46 switching the timing of applying and not applying the positive electric potential to the first common electrode 12C to 2AL, the jetting of liquid droplets from the nozzles 16*a* is prevented.

Figure 11A:
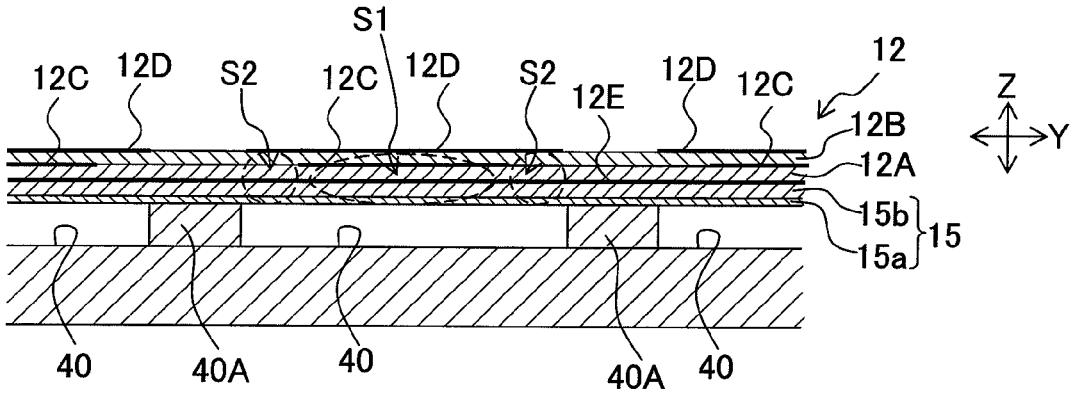
FIG. 11A, FIG. 11B, and FIG. 11C are explanatory diagrams showing deformed states respectively.
Figure 11B:
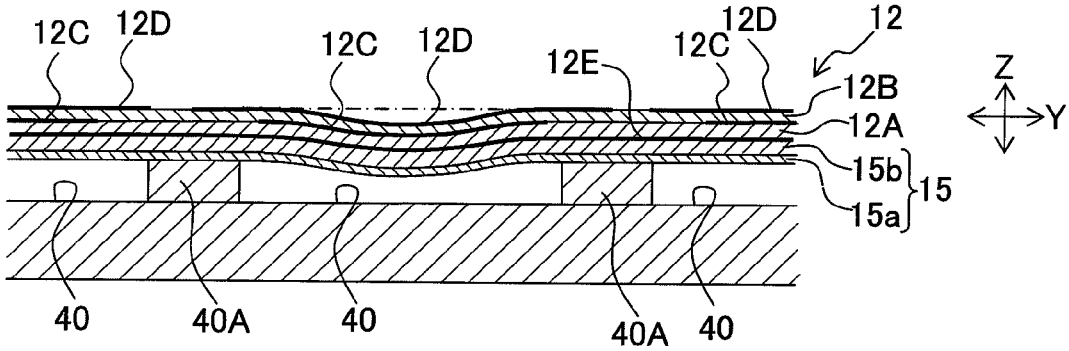
Figure 11C:
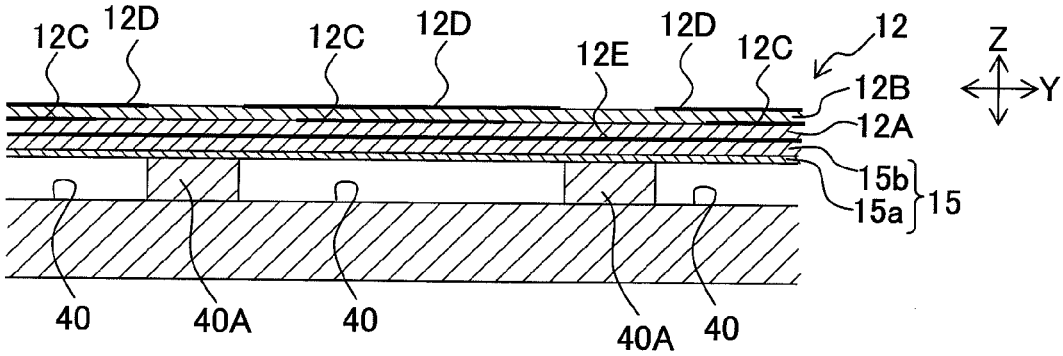

Concretely, by applying the positive electric potential to the first common electrode 12C in a state of the first individual electrode 12D and the second common electrode 12E at the ground electric potential, the pressure chamber 40 is changed from a reference state shown in FIG. 11A to a decreased volume state sown in FIG. 11B. Next, by letting the first common electrode to be at the ground electric potential, the pressure chamber 40 is made to regain the state from the decreased volume state shown in FIG. 11B to a reference state shown in FIG. 11C, in other words, the state shown in FIG. 11A. In other words, the second warm-up operation is performed by deforming only the deformable portion S1 of the piezoelectric actuator 12 corresponding to the central portion of the pressure chamber 40 toward the pressure chamber 40. Even when such change in the volume of the pressure chamber 40 is repeated, since a magnitude of the positive pressure applied is small as compared to the pressure applied in the ink jetting mode, the ink is not jetted from the nozzle 16*a*. However, since an amount of deformation (amount of deformation in a direction toward the pressure chamber 40) of the piezoelectric actuator 12 is same as an amount of deformation in the ink jetting mode, the piezoelectric actuator 12 generates the heat sufficiently. Therefore, it is possible to heat sufficiently the ink inside the pressure chamber 40 by using this heat.

Moreover, even by applying alternately the positive electric potential and the ground electric potential to the first individual electrode 12D and the first common electrode 12C almost at the same time in a state of the second common electrode 12E let to be at the ground electric potential, and by deforming the piezoelectric material layers 12A and 12B and the vibration plate 15 of the piezoelectric actuator 12, it is possible to make the piezoelectric actuator 12 generate heat. Moreover, it is possible heat the ink inside the pressure chamber 40 by the heat generated by the piezoelectric actuator 12.

Figure 12A:
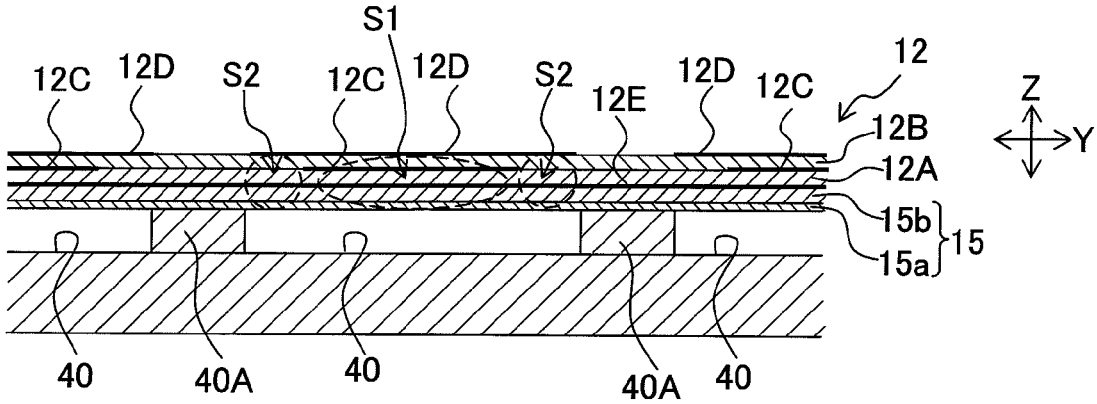
FIG. 12A, FIG. 12B, and FIG. 12C are explanatory diagrams showing deformed states respectively.
Figure 12B:
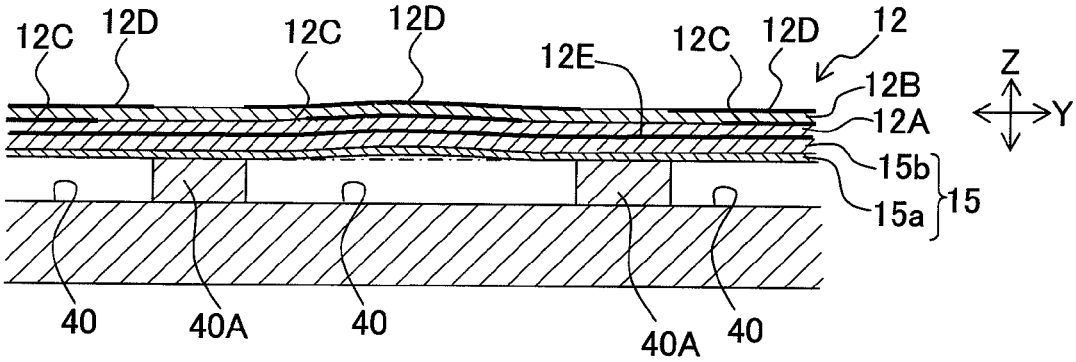

Concretely, by applying the positive electric potential to the first individual electrode 12D and the first common electrode 12C almost at the same time in the state of the second common electrode 12E let to be at the ground electric potential, the pressure chamber 40 is changed from a reference state shown in FIG. 12A to an increased volume state shown in FIG. 12B.

Figure 12C:
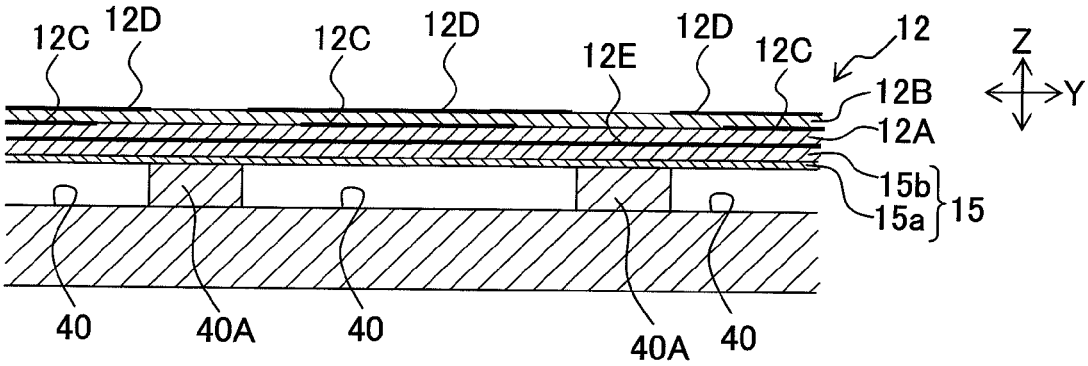

Next, by letting the first individual electrode 12D and the first common electrode 12C to be at the ground electric potential, the pressure chamber 40 regains the state from the increased volume state shown in FIG. 12B to a reference state shown in FIG. 12C, in other words, to the state shown in FIG. 12A. In other words, the first warm-up operation is carried out by displacing only the deformable portion S2 of the piezoelectric actuator 12, corresponding to the outer peripheral portion of the central portion of the pressure chamber 40 in a direction away from the pressure chamber 40. By repeatedly driving the piezoelectric actuator 12 in such manner, it is possible to make the piezoelectric actuator 12 generate heat, and to heat sufficiently the ink inside the pressure chamber 40 without jetting the ink from the nozzles 16*a*.

In the first warm-up operation and the second warm-up operation, the piezoelectric actuator 12 is driven such that the pressure chamber 40 is deformed between the reference state and the increased volume state or the decreased volume state, and only a part of a deformation drive of the piezoelectric actuator 12 in the ink jetting mode is used. Therefore, although the piezoelectric actuator 12 is deformed, since the magnitude of the positive pressure applied to the ink is small as compared to the pressure applied in the ink jetting mode, the ink is not jetted from the nozzle 16*a*. On the other hand, since the deformation for attaining the reference state is used for the increased volume state in which, the change in volume is maximum to an increased volume side of the pressure chamber 40 or for the decreased volume state in which the change is minimum to a decreased volume side of the pressure chamber 40, it is possible to deform the piezoelectric actuator 12 substantially, and to heat the ink sufficiently.

Incidentally, as shown in FIG. 3, the ink to be supplied to the pressure chamber 40 is stored in the manifold 50 which extends in Y-direction. Moreover, the pressure chambers 40 communicating with the same manifold are arranged in one row or two rows in Y-direction. When the pressure chambers 40 are arranged in rows in such manner, when the driving of the piezoelectric actuator is controlled to change the volume of only some of the pressure chambers 40 based on the drive pulse from the driving circuit 46 (driver 54), the change in the volume for the overall ink channels is small, and it is possible to reduce a possibility of the ink being jetted mistakenly.

For example, when the pressure chambers 40 communicating with the same manifold are arranged in one row, an arrangement may be made such that in the warm-up mode, a portion of the piezoelectric actuator 12 facing one of the two adjacent pressure chambers 40 in the direction of row of pressure chambers 40 is made to carry out any one of the first warm-up operation and the second warm-up operation, and a portion of the piezoelectric actuator 12 facing the other pressure chamber 40 is not made to carry out any warm-up operation. Moreover, an arrangement may be made such that the portion of the piezoelectric actuator 12 facing one of the two adjacent pressure chambers 40 is made to carry out the first warm-up operation, and the portion of the piezoelectric actuator 12 facing the other pressure chambers 40 is made to carry out the second warm-up operation with the same cycle. In this case, when one of the pressure chambers is in the increased volume state, the other pressure chamber is in the decreased volume state, and the pressure change for the overall pressure chambers 40 is cancelled.

Moreover, when the plurality of pressure chambers 40 communicating with the same manifold are arranged in two rows, similarly, in the warm-up mode, for instance, the control may be carried out such that a portion of the piezoelectric actuator 12 facing the pressure chambers 40 belonging to one of the two rows is made to carry out one of the first warm-up operation and the second warm-up operation, and a portion of the piezoelectric actuator 12 facing the pressure chambers 40 belonging to the other row is made to carry out none of the first warm-up operation and the second warm-up operation. Moreover, the portion of the piezoelectric actuator 12 facing the pressure chambers 40 belonging to one of the two rows may be made to carry out the first warm-up operation, and the portion of the piezoelectric actuator 12 facing the pressure chambers 40 belonging to the other row may be made to carry out the second warm-up operation with the same cycle.

It is also possible to have a similar effect as in the warm-up mode in the first embodiment by arranging the individual electrodes and the common electrodes of the piezoelectric actuator as in a second embodiment and a third embodiment which will be described later, apart from the first embodiment.

Figure 13A:
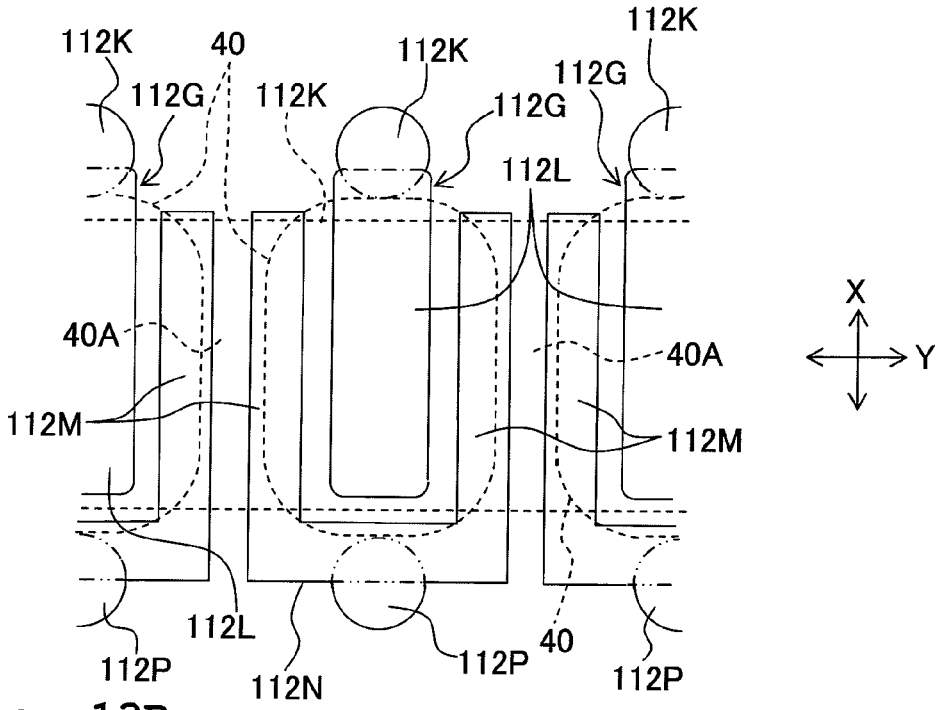
FIG. 13A, FIG. 13B, and FIG. 13C are diagrams of a second embodiment, similar to FIG. 4A, FIG. 4B, and FIG. 4C.
Figure 13B:
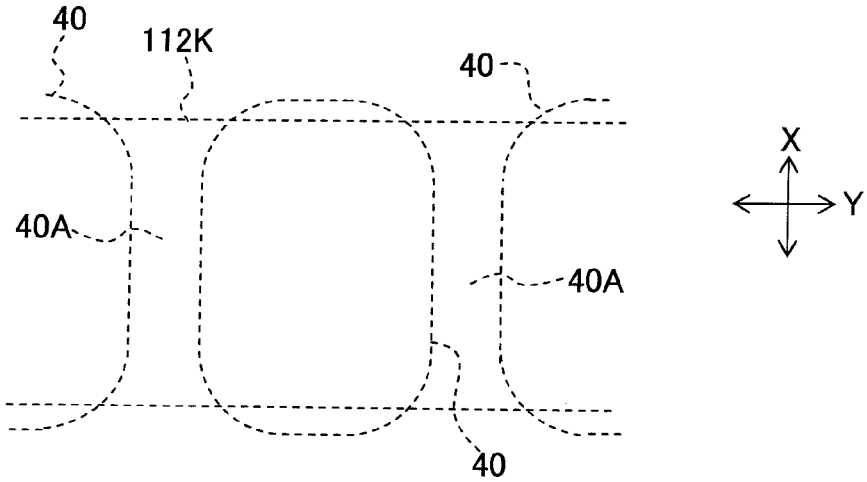
Figure 13C:
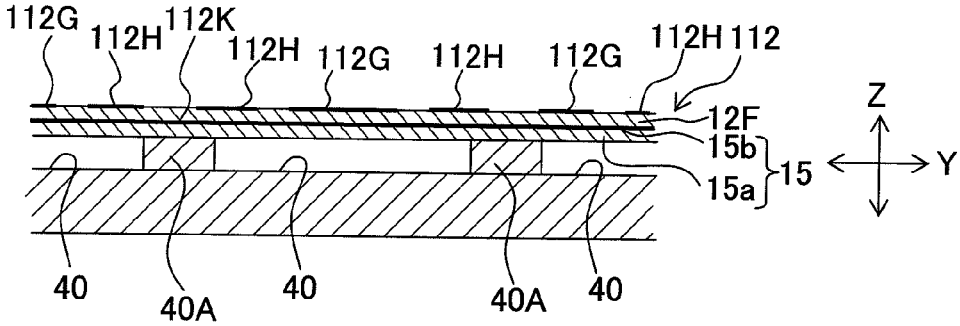
Figure 14:
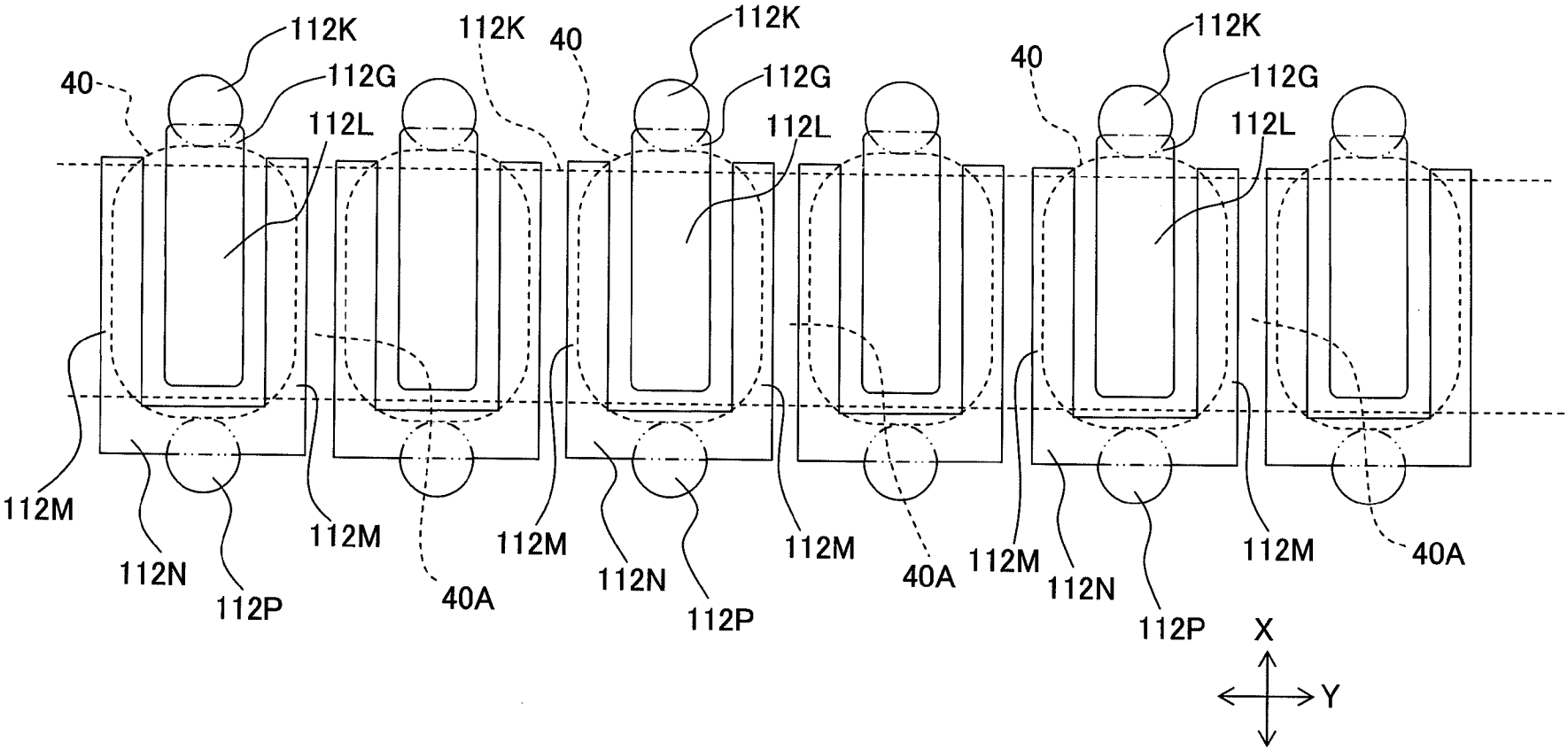
FIG. 14 is a diagram of the second embodiment, similar to FIG. 5.

Firstly, the second embodiment of the present invention will be described below. As shown in FIG. 13C, a piezoelectric actuator 112 has a piezoelectric material layer 12F polarized in a direction of thickness, which is formed on the vibration plate 15 (insulating layer 15*b*), and a second individual electrode 112G and a third individual electrode 112H are formed on an upper surface side (one surface side) of the piezoelectric material layer 12F and a third common electrode 112K is formed on a lower surface side (the other surface side) of the piezoelectric material layer 12F. As shown in FIG. 13A and FIG. 14, when viewed in Z-direction, the second individual electrode 112G has a portion 112L extending in a longitudinal direction of the pressure chamber 40 (X-direction), corresponding to a central portion in the width direction of the pressure chamber 40 (Y-direction), and has a connecting terminal portion 112K to be connected to a signal wire, on one side in the longitudinal direction of the pressure chamber 40. The third individual electrode 112H has a first portion 112M which is arranged on both sides of the second individual electrode 112G in the width direction of the pressure chamber 40, and a second portion 112N which connects them, on the other side in the longitudinal direction of the pressure chamber 40. Moreover, the third common electrode 112K is formed to extend in the width direction of the pressure chamber 40. As shown in FIG. 13C and FIG. 14, the third common electrode 112K has a portion corresponding to the second individual electrode 112G and the third individual electrode 112H in the width direction of the pressure chamber 40.

Figure 15A:
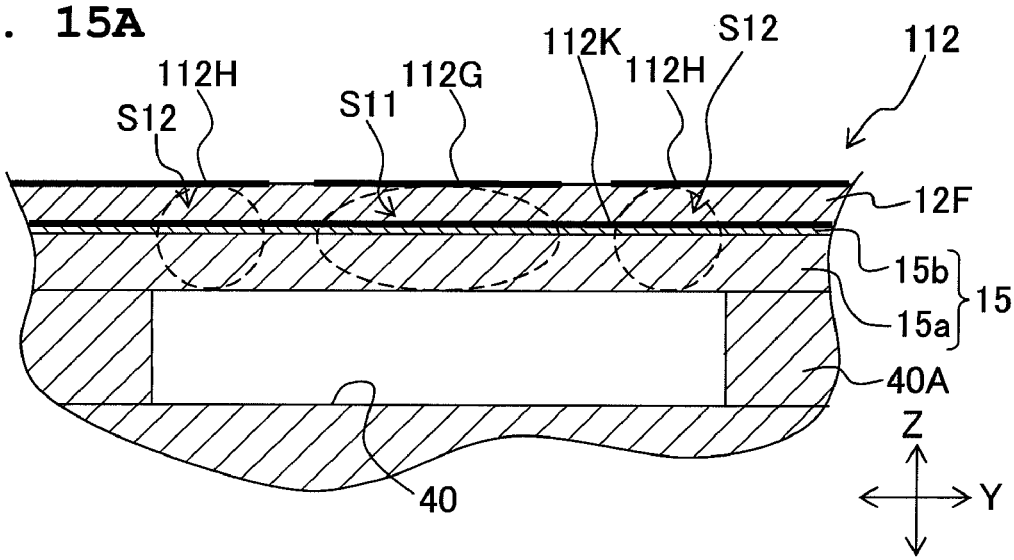
FIG. 15A, FIG. 15B, FIG. 15C, and FIG. 15D are explanatory diagrams of the second embodiment, showing deformed states respectively.
Figure 15B:
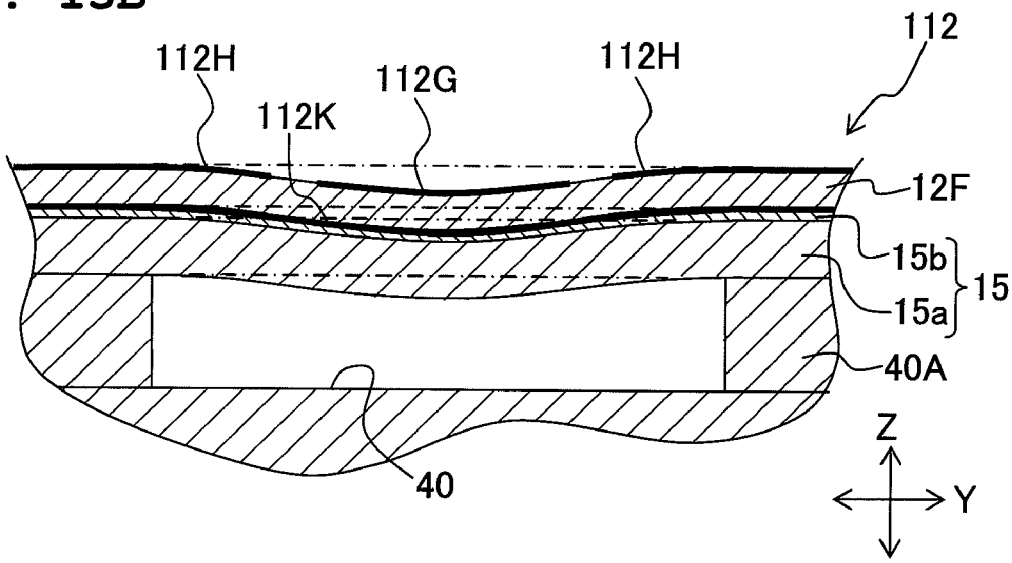
Figure 15C:
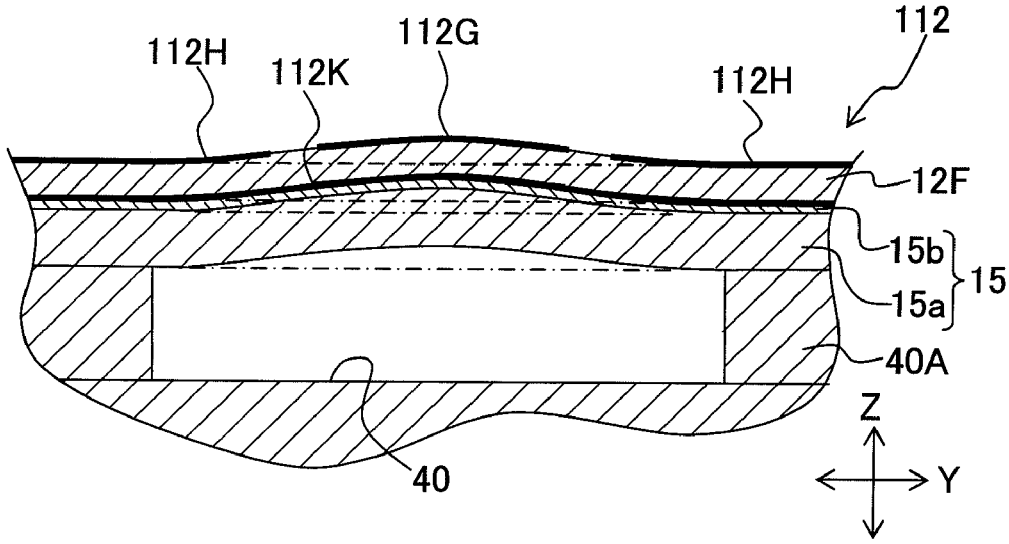

Moreover, in the ink jetting mode, as shown in FIG. 15A, from a state in which the second individual electrode 112G, the third individual electrode 112H, and the third common electrode 112K are let to be at the ground electric potential, and when the positive electric potential is applied only to the second individual electrode 112G, a portion of the piezoelectric material layer 12F sandwiched between the second individual electrode 112G and the third common electrode 112K (a first active portion) contracts in a planar direction thereof, and as shown in FIG. 15B, the vibration plate 15 undergoes the unimorph deformation to form a projection toward the pressure chamber 40 (a first state). In other words, a deformable portion (a first deformation portion) S11 of the piezoelectric actuator 112 corresponding to the central portion in the width direction of the pressure chamber 40 is deformed in the direction toward the pressure chamber 40. Accordingly, it is possible to make the pressure chamber 40 change the state from the reference state to the decreased volume state. Next, with the second individual electrode 112G let to be at the ground electric potential, when the positive electric potential is applied to the third individual electrode 112H, a portion of the piezoelectric material layer 12F sandwiched between the third individual electrode 112H and the third common electrode 112K (a second active portion) contracts in a planar direction thereof, and as shown in FIG. 15C, the vibration plate undergoes the unimorph deformation to form a projection in a direction away from the pressure chamber 40 (a second state). In other words, a deformable portion (second deformable portion) of the piezoelectric actuator 112 corresponding to an outer peripheral portion of a central portion in the width direction of the pressure chamber 40 is deformed in the direction away from the pressure chamber 40. Accordingly, it is possible to make the pressure chamber 40 change the state from the decreased volume state to the increased volume state. Moreover, once again, by applying the positive electric potential to the second individual electrode 112G and letting the third individual electrode 112H to be at the ground electric potential, the state of the pressure changes 40 changes to a decreased volume state shown in FIG. 15B. In other words, in a state of the third common electrode 112K let to be at the ground electric potential, the positive electric potential is applied alternately to the second individual electrode 112G and the third individual electrode 112H, and when the positive electric potential is not being applied, the ground electric potential is applied. Accordingly, it is possible to make the pressure chamber 40 change the state repeatedly to the decreased volume state shown in FIG. 15B and an increased volume state shown in FIG. 15C, and it is possible to jet the ink by the "pulling ejection" same as in the first embodiment.

In the warm-up mode, the piezoelectric actuator 112 is driven such that the positive electric potential and the ground electric potential are applied alternately to the second individual electrode 112G in a state of the third individual electrode 112H and the third common electrode 112K let to be at the ground electric potential, and the state of the pressure chamber 40 is repeatedly changed to a reference state in FIG.

15A and the decreased volume state in FIG. 15B alternately. In other words, only the deformable portion S11 of the piezoelectric actuator 112 corresponding to the central portion of the pressure chamber 40 is deformed toward the pressure chamber 40. By such driving, the piezoelectric actuator 112 generates heat, and the ink inside the pressure chamber 40 is heated (second warm-up operation).

Moreover, the piezoelectric actuator 112 may be driven such that the positive electric potential and the ground electric potential are applied alternately to the third individual electrode 112H in a state of the second individual electrode 112G and the third common electrode 112K let to be at the ground electric potential, and the state of the pressure chamber 40 is repeatedly changed to the reference state in FIG. 15A and the increased volume state in FIG. 15C alternately. In other words, only the deformable portion S12 of the piezoelectric actuator 112 corresponding to the outer peripheral side of the central portion of the pressure chamber 40 may be deformed (first warm-up operation).

In the warm-up mode, the electric potential to be applied to the second individual electrode 112G, the third individual electrode 112H, and the third common electrode 112K may be changed as follows.

By applying the positive electric potential and the ground electric potential alternately to the second individual electrode 112G and the third individual electrode 112H in a state of the third common electrode 112K let to be at the ground electric potential, a deformation directly proportional to a strength of an electric field is occurred in the piezoelectric actuator 112 (inverse piezoelectric effect), and the piezoelectric actuator 112 generates heat, thereby heating the ink. It is possible to prevent the jetting of ink by letting a timing at which the positive electric potential is applied and not applied to the second individual electrode 112G and the third individual electrode 112H to be 2AL, when a time for one-way propagation of a pressure wave inside the liquid channels of the printer head 3 including the pressure chambers 40 is let to be AL.

Figure 15D:
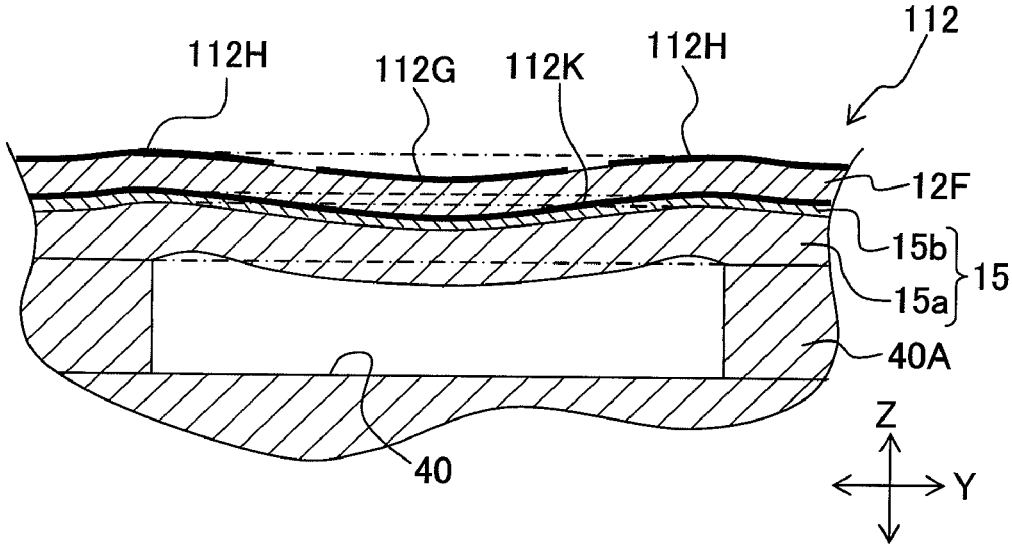

To put elaborately, the positive electric potential is applied to the second individual electrode 112G and the third individual electrode 112H in the state of the third common electrode 112K let to be at the ground electric potential. Accordingly, a voltage is applied to a portion of the piezoelectric material layer 12F corresponding to the central portion of the pressure chamber 40 (first active portion) and a portion of the piezoelectric material layer 12F corresponding to the outer peripheral portion of the pressure chamber 40 (second active portion). As a result, the portion of the piezoelectric material layer 12F corresponding to the central portion of the pressure chamber 40 contracts, and the portion of the vibration plate 15 corresponding to the central portion of the pressure chamber 40 undergoes the unimorph deformation to form a projection in the direction toward the pressure chamber 40, as well as the portion of the piezoelectric material layer 12F corresponding to the outer peripheral portion of the pressure chamber contracts and a portion of the vibration plate 15 corresponding to the outer peripheral portion of the pressure chamber 40 undergoes the unimorph deformation to form a projection in a direction away from the pressure chamber 40. This state is a state in FIG. 15D (third state). In the state in FIG. 15D, since the deformation of the deformable portion (first deformable portion) S11 of the piezoelectric actuator 112 corresponding to the central portion of the pressure chamber 40 and the deformation of the deformable portion (second deformable portion) S12 of the piezoelectric actuator 112 corresponding to the outer peripheral portion of the pressure chamber 40 cancel with each other, the volume of the pressure chamber 40 almost does not change from the volume in the reference state shown in FIG. 15A.

Next, by letting the second individual electrode 112G and the third individual electrode 112H to be at the ground electric potential in the state of the third common electrode 112K let to be at the ground electric potential, both the portion of the piezoelectric material layer 12F corresponding to the central portion of the pressure chamber 40 and the portion of the piezoelectric material layer 12F corresponding to the outer peripheral portion of the pressure chamber 40 are not deformed (a fourth state), and the pressure chamber 40 assumes the reference state shown in FIG. 15A.

When the piezoelectric actuator 112 is driven as described above, it is possible to heat the ink by making the piezoelectric actuator 112 generate heat. Moreover, since the volume of the pressure chamber 40 almost does not change by driving of the piezoelectric actuator 112, there is no possibility of the ink being jetted mistakenly. Moreover, since the deformable portions of the piezoelectric actuator 112 are deformed as described above, the overall piezoelectric actuator 112 generates heat uniformly, and it is possible to heat the ink efficiently.

Furthermore, since there is no possibility of the ink being jetted mistakenly in the warm-up mode, it is possible to let the positive electric potential to be applied to the second individual electrode 112G, the third individual electrode 112H by a drive pulse which is output from the driving circuit 46 (driver 54) to be greater than the positive electric potential which is to be applied to the second individual electrode 112G and the third individual electrode 112H in the ink jetting mode. Consequently, since it is possible to make the voltage to be applied to the portion of the piezoelectric material layer 12F corresponding to the central portion of the pressure chamber 40 and to the portion of the piezoelectric material layer 12F corresponding to the outer peripheral portion of the pressure chamber 40 to be greater than the voltage to be applied in the ink jetting mode, it is possible improve further the efficiency of heating by increasing the amount of deformation of the piezoelectric actuator 112. Moreover, it is also possible to improve further the efficiency of heating by increasing the amount of deformation of the piezoelectric actuator 112 not only by making high the positive electric potential to be applied to the second individual electrode 112G and the third individual electrode 112H, but also by making a pulse width of the voltage to be applied to the second individual electrode 112G and the third individual electrode 112H (in other words, a pulse width of the drive pulse) to be wider than a pulse width of the voltage to be applied in the ink jetting mode.

In the second embodiment and a modified embodiment thereof, the second individual electrode 112G and the third individual electrode 112H are formed on the upper surface side of the piezoelectric material layer 12F, and the third common electrode 112K is formed on the lower surface side of the piezoelectric material layer 12F. However, the third common electrode 112K may be formed on the upper surface side of the piezoelectric material layer 12F and the second individual electrode 112G and the third individual electrode 112H may be formed on the lower surface side of the piezoelectric material layer 12F.

Figure 16A:
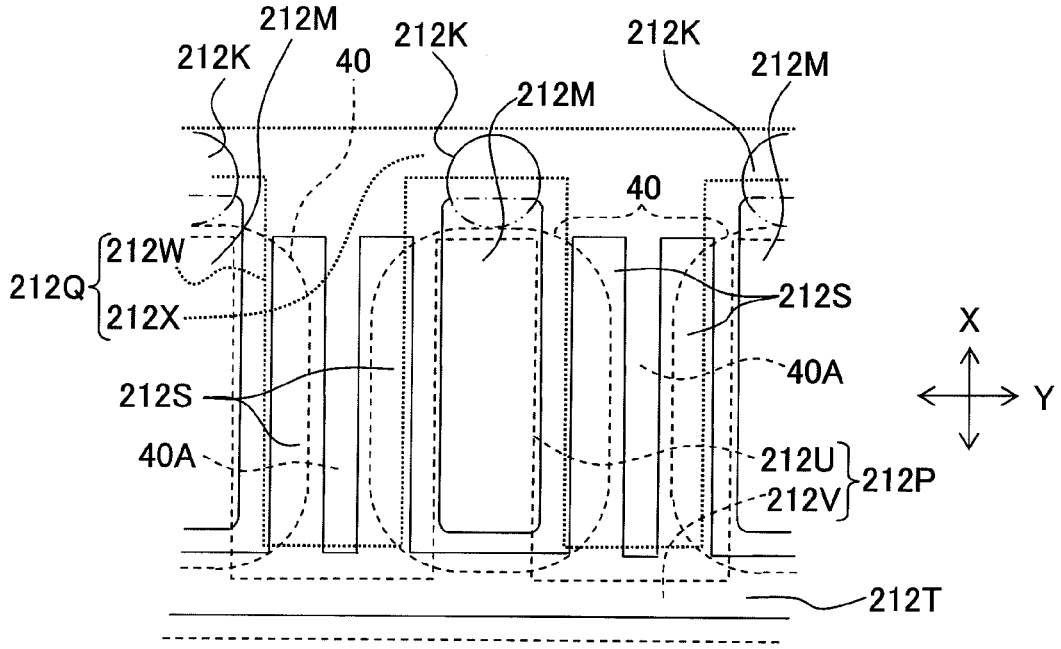
FIG. 16A, FIG. 16B, and FIG. 16C are diagrams of a third embodiment, similar to FIG. 4A to FIG. 4C.

Next, the third embodiment of the present invention will be described below. As shown in FIG. 16C, a piezoelectric actuator 212 includes the piezoelectric material layer 12F polarized in Z-direction which is formed on the vibration plate 15 (an insulating layer 15*b*), a plurality of fourth individual electrodes 212M each extending in the longitudinal direction of each pressure chamber 40 (X-direction) and being formed to face a central portion of each pressure chamber 40 on an upper surface side of the piezoelectric material layer 12F, and a fourth common electrode 212N, a fifth common electrode 212P, and a sixth common electrode 212Q formed on an upper surface side and a lower surface side of the piezoelectric material layer 12F. When viewed in Z-direction, as shown in FIG. 16A and FIG. 17, the fourth common electrode 212N, has a plurality of first portions 212S extending in the longitudinal direction of the pressure chamber 40, facing the outer peripheral portion of the pressure chamber 40 which are arranged at both sides of the fourth individual electrode 212M in the width direction of the pressure chamber 40, and a second portion 212T extending in the width direction of the pressure chamber 40, which connects the first portions 212S at one end side in the longitudinal direction of the pressure chamber 40.

Figure 16B:
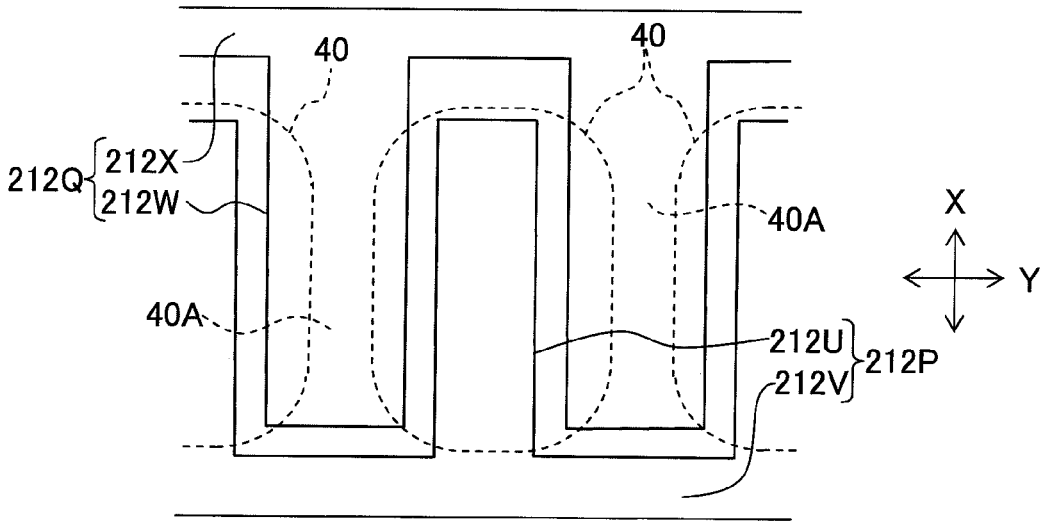
Figure 16C:
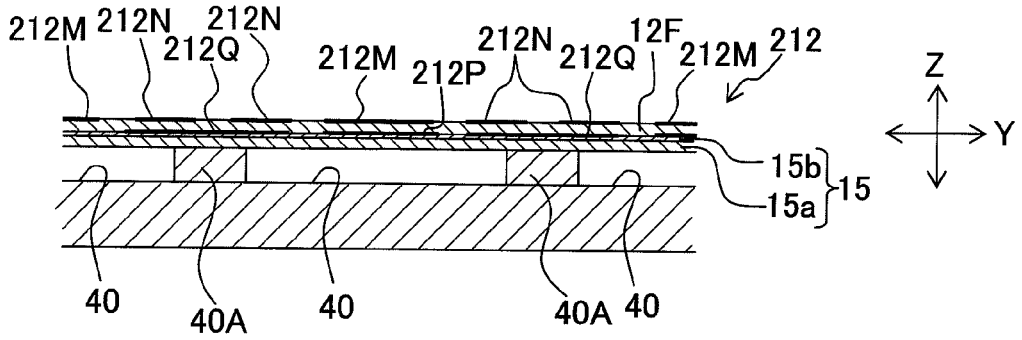
Figure 17:
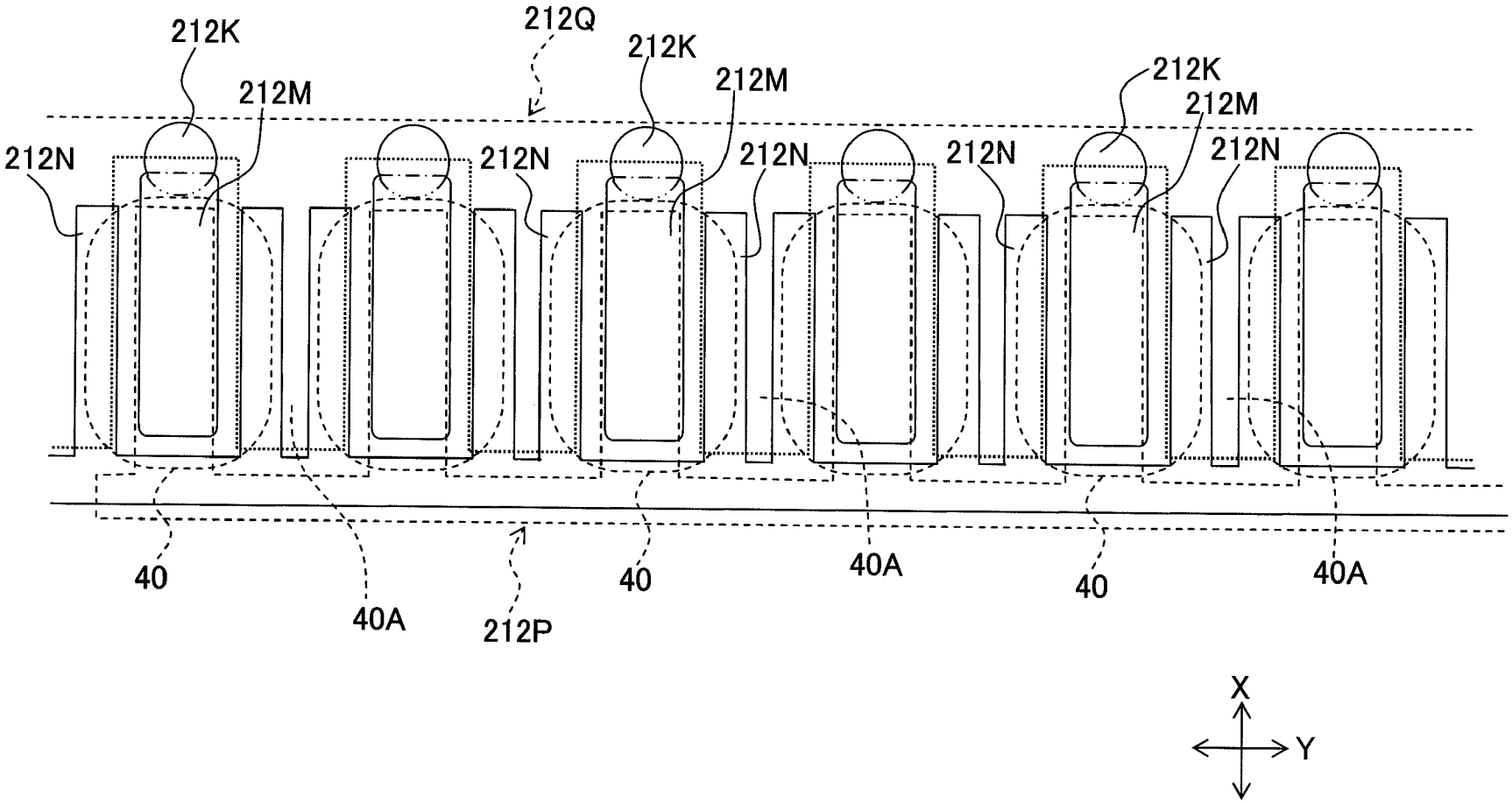
FIG. 17 is a diagram of the third embodiment, similar to FIG. 5.

Moreover, as shown in FIG. 16B and FIG. 17, the fifth common electrode 212P has a plurality of first portions 212U extending in the longitudinal direction of the pressure chamber 40 (X-direction) which are formed corresponding to the central portion of the width direction of each pressure chamber 40 (Y-direction), and a second portion 212V extending in the width direction of the pressure chamber 40, which connects the first portions 212U of the fifth common electrode 212P mutually at one end side in the longitudinal direction of the pressure chamber 40. The sixth common electrode 212Q, in the width direction of the pressure chamber 40 (Y-direction), has a plurality of first portions 212W extending in the longitudinal direction of the pressure chamber 40 (X-direction) which are arranged at both sides (two sides) of the first portion 212U of the fifth common electrode 212P, and a second portion 212X extending in the width direction of the pressure chamber 40, which connects the first portions 212W of the sixth common electrode 212Q at the other end side in the longitudinal direction of the pressure chamber 40. Moreover, as shown in FIG. 17, when viewed in Z-direction, the sixth common electrode 212Q is arranged corresponding to the fourth common electrode 212N, and the fifth common electrode 212P is arranged corresponding to the fourth individual electrode 212M. Further, as shown in FIG. 16B, the first portion 212W of the sixth common electrode 212Q is provided to be spreading over the two adjacent pressure chambers 40.

In the ink jetting mode, from a state in which, the fourth individual electrode 212M, the fifth common electrode 212P, and the sixth common electrode 212Q are let to be at the ground electric potential, the positive electric potential is applied to the fourth individual electrode 212M, the fourth common electrode 212N, and the sixth common electrode 212Q. Accordingly, a portion of the piezoelectric material layer 12F sandwiched between the fourth individual electrode 212M and the fifth common electrode 212P contracts, and the vibration plate 15 undergoes unimorph deformation to form a projection toward the pressure chamber 40 (first state). In other words, only a deformable portion (first deformable portion) S21 of the piezoelectric actuator 212 corresponding to the central portion of the pressure chamber 40 is deformed in the direction toward the pressure chamber 40. As a result, it is possible to change the state of the pressure chamber 40 from a reference state in FIG. 18A to a decreased volume state in FIG. 18B. Next, the fourth individual electrode 212M and the sixth common electrode 212Q are let to be at the ground electric potential while maintaining the fifth common electrode 212P at the ground electric potential and the fourth common electrode 212N at the positive electric potential. Accordingly, a portion of the piezoelectric material layer 12F sandwiched between the fourth common electrode 212N and the sixth common electrode 212Q contracts, and the vibration plate 15 undergoes the unimorph deformation to form a projection in the direction away from the pressure chamber 40 (second state). In other words, only a deformable portion (second deformable portion) S22 of the piezoelectric actuator 212 corresponding to the outer peripheral portion of the central portion of the pressure chamber 40 is deformed in the direction away from the pressure chamber 40. As a result, it is possible to change the state of the pressure chamber 40 to an increased volume state shown in FIG. 18C. Moreover, by applying once again the positive electric potential to the fourth individual electrode 212M and the sixth common electrode 212Q, it is possible to change the state of the pressure chamber 40 to a decreased volume state shown in FIG. 18B. In the manner described above, even in the third embodiment, it is possible to make jet the ink by the "pulling ejection" same as in the first embodiment.

Figure 18A:
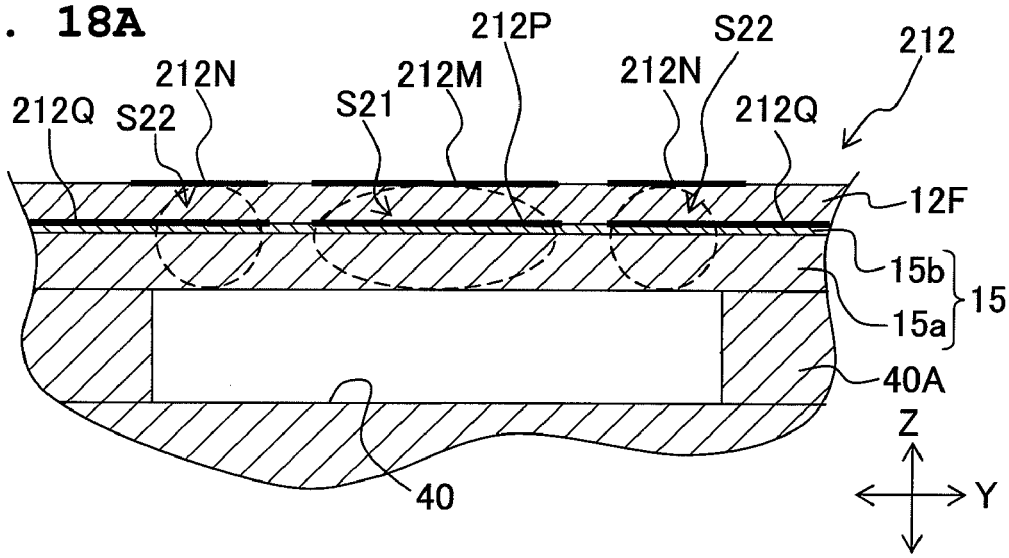
FIG. 18A, FIG. 18B, FIG. 18C and FIG. 18D are explanatory diagrams of the third embodiment, showing deformed states respectively
Figure 18B:
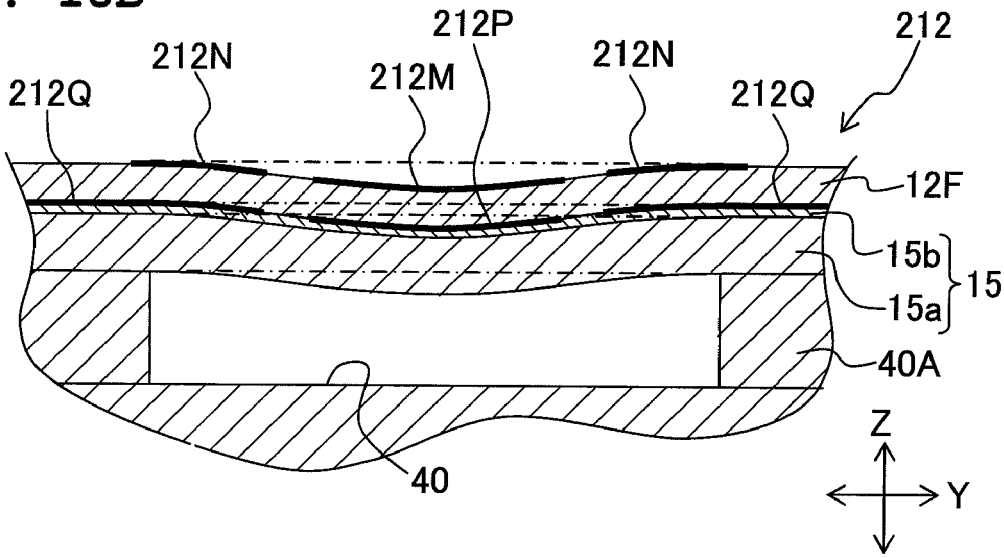

In the warm-up mode, by driving the piezoelectric actuator 212 such that a reference state in FIG. 18A and the decreased volume state in FIG. 18B are repeated alternately, the heat is generated by the piezoelectric actuator 212 without the ink being jetted, and it is possible to heat the ink in the pressure chamber 40 (second warm-up operation).

Figure 18C:
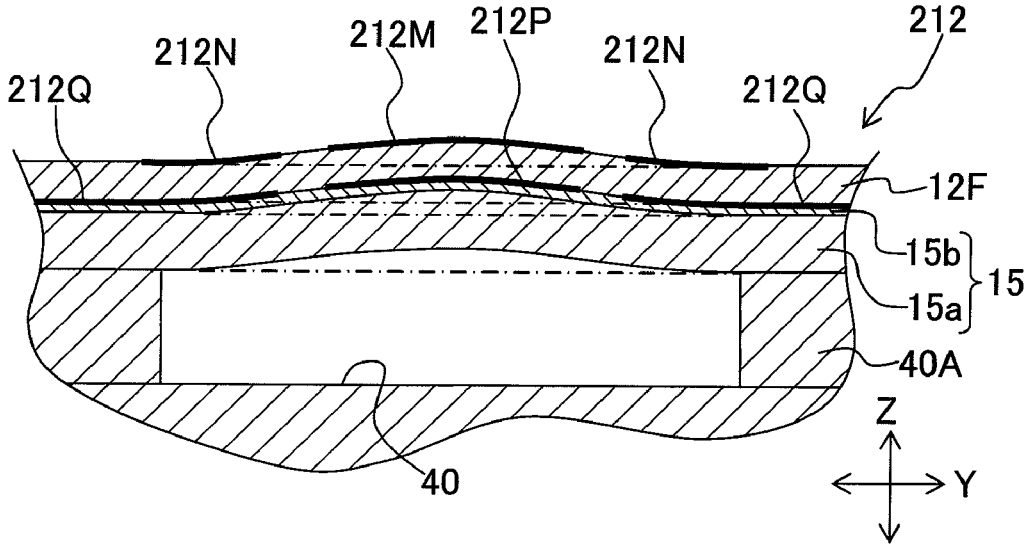

Moreover, the piezoelectric actuator 212 may be driven such that the reference state in FIG. 18A and an increased volume state in FIG. 18C are repeated alternately (first warm-up operation).

In the warm-up mode, the electric potential to be applied to the fourth individual electrode 212M, the fourth common electrode 212N, the fifth common electrode 212P, and the sixth common electrode 212Q may be changed as follows.

Figure 18D:
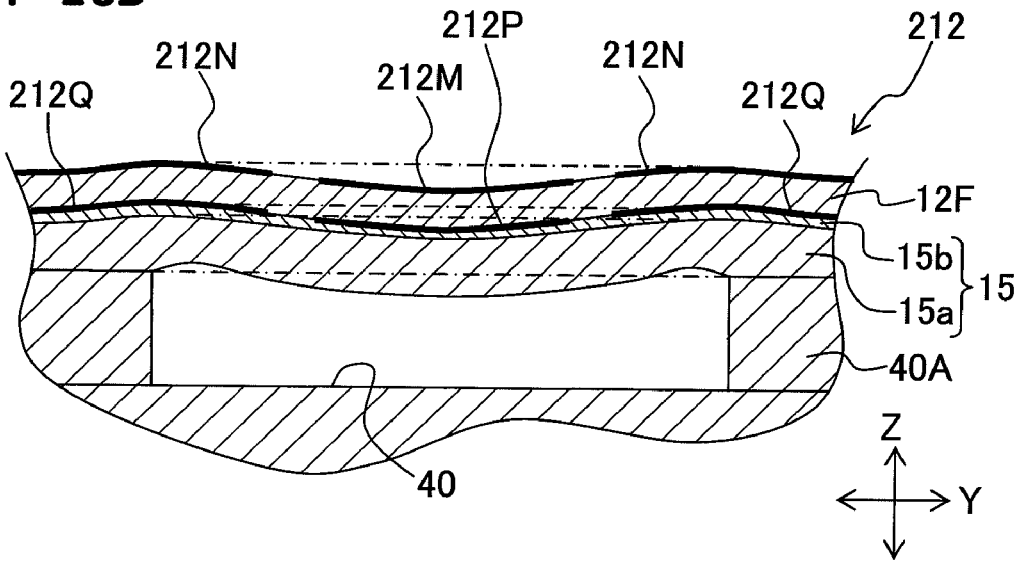

By repeatedly applying and not applying the positive electric potential to the fourth individual electrode 212M and the fourth common electrode 212N in a state of the fifth common electrode 212P and the sixth common electrode 212Q let to be at the ground electric potential, the piezoelectric actuator 212 generates heat, and the ink is heated. Concretely, the positive electric potential is applied to the fourth individual electrode 212M and the fourth common electrode 212N in the state of the fifth common electrode 212P and the sixth common electrode 212Q let to be at the ground electric potential. Accordingly, a voltage is applied to a portion of the piezoelectric material layer 12F corresponding to the central portion of the pressure chamber 40 and a portion of the piezoelectric material layer 12F corresponding to an outer peripheral side portion of the central portion of the pressure chamber 40. As a result, the portion of the piezoelectric material layer 12F corresponding to the central portion of the pressure chamber 40 contracts, and the portion of the vibration plate 15 corresponding to the central portion of the pressure chamber 40 undergoes the unimorph deformation to form a projection toward the pressure chamber 40, and also the portion of the piezoelectric material layer 12F corresponding to the outer peripheral portion of the pressure chamber 40 contracts, and the portion of the vibration plate 15 corresponding to the outer peripheral portion of the pressure chamber 40 undergoes the unimorph deformation to form a projection in the direction away from the pressure chamber 40. This state is a state in FIG. 18D (third state). In the state in FIG. 18D, since a deformation of the deformable portion (the first deformable portion) S21 of the piezoelectric actuator 212 corresponding to the central portion of the pressure chamber 40 and a deformation of the deformable portion (the second deformable portion) S22 of the piezoelectric actuator 212 corresponding to the outer peripheral portion of the pressure chamber 40 are cancelled mutually, the volume of the pressure chamber 40 almost does not change from the reference volume in the state shown in FIG. 18A. Next, by letting the fourth individual electrode 212M and the fourth common electrode 212N to be at the ground electric potential in the state of the fifth common electrode 212P and the sixth common electrode 212Q let to be at the ground electric potential, the pressure chamber 40 assumes the reference state shown in FIG. 18A, without both the portion of the piezoelectric material layer 12F corresponding to the central portion of the pressure chamber 40 and the portion corresponding to the outer peripheral portion of the pressure chamber 40 being deformed (fourth state). The piezoelectric actuator 212 generates heat by being driven in such manner, and it possible to heat the ink. Since the volume of the pressure chamber 40 almost does not change during the driving of the piezoelectric actuator 212, there is no possibility that the ink is jetted mistakenly.

Even in this modified embodiment, since there is no possibility that the ink is jetted mistakenly, a positive electric potential to be applied to the fourth individual electrode 212M and the fourth common electrode 212N by a drive pulse which is output from the driving circuit 46 (driver 54) may be let to be higher than a positive electric potential to be applied to the fourth individual electrode 212M and the fourth common electrode 212N in the ink jetting mode, and a voltage to be applied to the piezoelectric actuator 212 may be let to be higher than a voltage to be applied in the ink jetting mode. Or, it is also possible to improve the efficiency of heating by making substantial an amount of deformation of the piezoelectric actuator 212 by making a pulse width of the voltage to be applied to the fourth individual electrode 212M and the fourth common electrode 212N (in other words, the pulse width of the drive pulse) to be wider than a pulse width of the voltage to be applied to the fourth individual electrode 212M and the fourth common electrode 212N in the ink jetting mode.

In the third embodiment and the modified embodiment thereof, the fourth individual electrode 212M and the fourth common electrode 212N are arranged on the upper surface side of the piezoelectric material layer 12F, and the fifth common electrode 212P and the sixth common electrode 212Q are arranged on the lower surface side of the piezoelectric material layer 12A. However, the fifth common electrode 212P and the sixth common electrode 212Q may be arranged on the upper surface side of the piezoelectric material layer 12A, and the fourth individual electrode 212M and the fourth common electrode 212N may be arranged on the lower surface side of the piezoelectric material layer 12A.

It is also possible to make the following changes in the embodiments described above.

In the embodiments described above, cases in which the liquid droplet jetting apparatus is an ink-jet printer have been described. However, the present invention is not restricted to the ink-jet printer, and is also applicable to other liquid droplet jetting apparatuses which apply a colored liquid as small droplets, or forms a wiring pattern by jetting an electroconductive liquid.

In the present invention, not only a recording paper but also various materials such as resins and cloth can also be used as a recording medium, and not only an ink but various liquids such as a colored liquid and a functional liquid can be used as a liquid to be jetted.

What is claimed is:

1. A liquid droplet jetting apparatus which jets liquid droplets of a liquid, comprising:

a liquid droplet jetting head having a cavity unit in which a pressure chamber extending in a predetermined direction and having a predetermined volume and a nozzle communicating with the pressure chamber are formed, and a piezoelectric actuator which is joined to the cavity unit to cover the pressure chamber, and which applies pressure to the liquid in the pressure chamber; and a controller which controls the piezoelectric actuator in a liquid droplet jetting mode of jetting the liquid droplets from the nozzle and in a warm-up mode of heating the liquid in the pressure chamber without jetting the liquid in the pressure chamber as the liquid droplets from the nozzle, wherein in the liquid droplet jetting mode, the controller controls the piezoelectric actuator to perform a liquid droplet jetting operation by which volume of the pressure chamber is decreased to a decreased volume smaller than the predetermined volume, and then the volume of the pressure chamber is increased to a increased volume greater than the predetermined volume, and the volume of the pressure chamber is again decreased to the decreased volume; and in the warm-up mode, the controller controls the piezoelectric actuator to perform at least one of a first warm-up operation to change the volume of the pressure chamber repeatedly between the predetermined volume and the increased volume, and a second warm-up operation to change the volume of the pressure chamber repeatedly between the predetermined volume and the decreased volume.

2. The liquid droplet jetting apparatus according to claim 1, wherein the piezoelectric actuator has a first deformable portion and a second deformable portion, and the first deformable portion and the second deformable portion are deformed in different directions with each other, and the controller controls the piezoelectric actuator to deform the first deformable portion and the second deformable portion such that the volume of the pressure chamber is changed.

3. The liquid droplet jetting apparatus according to claim 2, wherein the first deformable portion corresponds to a central portion of the pressure chamber, and the second deformable portion corresponds to outer peripheral portion, of the pressure chamber, outside the central portion.

4. The liquid droplet jetting apparatus according to claim 3, wherein the controller controls the piezoelectric actuator to perform the second warm-up operation by deforming the first deformable portion, and to perform the first warm-up operation by deforming the second deformable portion.

5. The liquid droplet jetting apparatus according to claim 1, further comprising a manifold extending in an orthogonal direction orthogonal to the predetermined direction and storing the liquid to be supplied to the pressure chamber, wherein the pressure chamber is formed as a plurality of pressure chambers arranged in a row in the orthogonal direction and communicating with the manifold;

the piezoelectric actuator has a plurality of deformable portions which correspond to the pressure chambers respectively, and each of which is deformed to perform the liquid droplet jetting operation, and the first warm-up operation and the second warm-up operation; and in the warm-up mode, the controller controls the piezoelectric actuator such that when a deformable portion corresponding to one of two adjacent pressure chambers among the pressure chambers is deformed to perform one of the first warm-up operation and the second warm-up operation, a deformable portion, corresponding to the other pressure chamber of the two adjacent pressure chambers is not deformed and any of the first warm-up operation and the second warm-up operation is not performed.

6. The liquid droplet jetting apparatus according to claim 1, further comprising a manifold extending in an orthogonal direction orthogonal to the predetermined direction and storing the liquid to be supplied to the pressure chamber, wherein the pressure chamber is formed as a plurality of pressure chambers arranged in a row in the orthogonal direction and communicating with the manifold;

the piezoelectric actuator has a plurality of deformable portions which correspond to the pressure chambers respectively, and each of which is deformed to perform the liquid droplet jetting operation, and the first warm-up operation and the second warm-up operation; and in the warm-up mode, the controller controls the piezoelectric actuator such that when a deformable portion, corresponding to one of two adjacent pressure chambers among the pressure chambers is deformed to perform the first warm-up operation, a deformable portion, corresponding to the other pressure chamber of the two adjacent pressure chambers, is deformed to perform the second warm-up operation at a same cycle as a cycle of the first warm-up operation.

7. The liquid droplet jetting apparatus according to claim 1, further comprising a manifold extending in an orthogonal direction orthogonal to the predetermined direction and storing the liquid to be supplied to the pressure chamber, wherein the pressure chamber is formed as a plurality of pressure chambers arranged in two rows in the orthogonal direction and communicating with the manifold, the piezoelectric actuator has a plurality of deformable portions which correspond to the pressure chambers respectively, and each of which is deformed to perform the liquid droplet jetting operation, and the first warm-up operation and the second warm-up operation; and in the warm-up mode, the controller controls the piezoelectric actuator such that when deformable portions corresponding to the pressure chambers forming one row of the two rows are deformed to perform one of the first warm-up operation and the second warm-up operation, deformable portions, corresponding to pressure chambers forming the other row of the two rows, are not deformed and any of the first warm-up operation and the second warm-up operation is not performed.

8. The liquid droplet jetting apparatus according to claim 1, further comprising a manifold extending in an orthogonal direction orthogonal to the predetermined direction and storing the liquid to be supplied to the pressure chamber, wherein the pressure chamber is formed as a plurality of pressure chambers arranged in two rows in the orthogonal direction and communicating with the manifold;

the piezoelectric actuator has a plurality of deformable portions which correspond to the pressure chambers respectively, and each of which is deformed to perform the liquid droplet jetting operation, and the first warm-up operation and the second warm-up operation; and in the warm-up mode, the controller controls the piezoelectric actuator such that when deformable portions corresponding to pressure chambers among the plurality of pressure chambers forming one row of the two rows, are deformed to perform the first warm-up operation, a deformable portions, corresponding to pressure chambers forming the other row of the two rows, are deformed to perform the second warm-up operation at a same cycle as a cycle of the first warm-up operation.

9. The liquid droplet jetting apparatus according to claim 1, further comprising an electric potential applying mechanism which applies an electric potential to the piezoelectric actuator, wherein the piezoelectric actuator has at least two piezoelectric material layers, a first common electrode which is provided between the two piezoelectric material layers, a first individual electrode which is provided on a surface, of one of the piezoelectric material layers, opposite to a surface on which the first common electrode is provided, and a second common electrode which is provided on a surface, of the other of the piezoelectric material layers, opposite to a surface on which the first common electrode is provided;

the first common electrode has a portion facing a central portion, of the pressure chamber, in width direction of the pressure chamber, and the first individual electrode and the second common electrode have portions which are formed to be longer than the first common electrode in the width direction of the pressure chamber respectively; and in the liquid droplet jetting mode, the controller controls the electric potential applying mechanism to apply to the first individual electrode an electric potential in order of ground electric potential, a positive electric potential, and the ground electric potential, in a state that the positive electric potential is applied to the first common electrode and the second common electrode is at the ground electric potential; and in the warm-up mode, the controller controls the electric potential applying mechanism to apply alternately the positive electric potential and the ground electric potential to the first common electrode in a state that the first individual electrode and the second common electrode are at the ground electric potential, or to apply alternately the positive electric potential and the ground electric potential substantially simultaneously to the first individual electrode and the first common electrode in a state that the second common electrode is at the ground electric potential.

10. The liquid droplet jetting apparatus according to claim 9, wherein when a time during which a pressure wave is propagated one-way in a liquid channel, of the liquid droplet jetting head, including the pressure chambers is AL, the electric potential applying mechanism switches between application of the electric potential and non-application of the electric potential at a timing of 2AL.

11. The liquid droplet jetting apparatus according to claim 1, further comprising an electric potential applying mechanism which applies an electric potential to the piezoelectric actuator, wherein the piezoelectric actuator has at least one piezoelectric material layer, a second individual electrode and a third individual electrode which are provided on a side of one surface of the piezoelectric material layer, and a third common electrode which is provided on a side of the other surface of the piezoelectric material layer;

the second individual electrode has a portion facing a central portion of the pressure chamber in a width direction of the pressure chamber; the third individual electrode is arranged on both sides of the second individual electrode in the width direction of the pressure chamber and the third common electrode has a portion facing the second and the third individual electrode in the width direction of the pressure chamber;

in the liquid droplet jetting mode, the controller controls the electric potential applying mechanism such that a ground electric potential is applied to the third individual electrode and the third common electrode and a positive electric potential is applied to the second individual electrode, and then the ground electric potential is applied to the second individual electrode and the third common electrode and the positive electric potential is applied to the third individual electrode, and then the ground electric potential is again applied to the third individual electrode and the third common electrode and a positive electric potential is again applied to the second individual electrode; and in the warm-up mode, the controller controls the electric potential applying mechanism to alternately apply the positive electric potential and the ground electric potential to one of the second individual electrode and the third individual electrode in a state that the third common electrode is at the ground electric potential.

12. The liquid droplet jetting apparatus according to claim 11, wherein when a time during which a pressure wave is propagated one-way in a liquid channel, of the liquid droplet jetting head, including the pressure chambers is AL, the electric potential applying mechanism switches between application of the electric potential and non-application of the electric potential at a timing of 2AL.

13. The liquid droplet jetting apparatus according to claim 1, further comprising an electric potential applying mechanism which applies an electric potential to the piezoelectric actuator, wherein the piezoelectric actuator has at least one piezoelectric material layer, a fourth individual electrode and a fourth common electrode which are provided on a side of one surface of the piezoelectric material layer, and a fifth common electrode and a sixth common electrode which are provided on a side of the other surface of the piezoelectric material layer;

the fourth individual electrode has a portion facing a central portion, of the pressure chamber, in a width direction of the pressure chamber, and the fourth common electrode is arranged on both sides of the fourth individual electrode in the width direction of the pressure chamber; and the fifth common electrode and the sixth common electrode have portions facing the fourth individual electrode and the fourth common electrode, respectively, in the width direction of the pressure chamber;

in the liquid droplet jetting mode, the controller controls the electric potential applying mechanism such that a ground electric potential is applied to the fourth individual electrode, the fifth common electrode, and the sixth common electrode and a positive electric potential is applied to the fourth common electrode, then the ground electric potential is applied to the sixth common electrode and a positive electric potential is applied to the fourth individual electrode, the fourth common electrode, and the fifth common electrode, and then the ground electric potential is applied again to the fourth individual electrode, the fifth common electrode, and the sixth common electrode and a positive electric potential is applied again to the fourth common electrode; and in the warm-up mode, the controller controls the electric potential applying mechanism such that application and non-application of the positive electric potential to the fourth common electrode is repeated in a state that the ground electric potential is applied to the fourth individual electrode, the fifth common electrode, and the sixth common electrode, or application and non-application of the positive electric potential to the fourth individual electrode, fourth common electrode, and the fifth common electrode is repeated in a state that the ground electric potential is applied to the sixth common electrode.

14. The liquid droplet jetting apparatus according to claim 13, wherein when a time during which a pressure wave is propagated one-way in a liquid channel, of the liquid droplet jetting head, including the pressure chambers is AL, the electric potential applying mechanism switches between application of the electric potential and non-application of the electric potential at a timing of 2AL.

15. The liquid droplet jetting apparatus according to claim 1, wherein the liquid droplet jetting head has a temperature detector which detects a temperature corresponding to a temperature of the liquid in the pressure chamber, and the controller selects to perform the warm-up mode only when the temperature of the liquid is not more than a predetermined value.

16. A liquid droplet jetting apparatus which jets liquid droplets of a liquid, comprising:

a liquid droplet jetting head having a cavity unit in which a pressure chamber extending in a predetermined direction and a nozzle communicating with the pressure chamber are formed, and a piezoelectric actuator which is joined to the cavity unit to cover the pressure chamber, which applies pressure to the liquid in the pressure chamber, and which has first active portion corresponding to a central portion of the pressure chamber, and a second active portion corresponding to outer peripheral portion, of the pressure chamber, outside the central portion; and a voltage applying mechanism which applies a voltage to the piezoelectric actuator in a liquid droplet jetting mode of jetting the liquid droplets from the nozzle and a warm-up mode of heating the liquid inside the pressure chamber without jetting the liquid as liquid droplets from the nozzle, wherein in the liquid droplet jetting mode, the voltage applying mechanism applies the voltage to the first active portion and does not apply the voltage to the second active portion to provide a first state in which the first active portion is deformed to project toward the pressure chamber, and then the voltage applying mechanism applies the voltage to the second active portion and does not apply the voltage to the first active portion to provide a second state in which the second active portion is deformed to project in a direction away from the pressure chamber, and then the first state is again provided; and in the warm-up mode, the voltage applying mechanism applies the voltage to both the first active portion and the second active portion to provide a third state in which the first active portion is deformed to project toward the pressure chamber and the second active portion is deformed to project in the direction away from the pressure chamber, and then the voltage applying mechanism does not apply any voltage to the first active portion and the second active portion to provide a fourth state in which both the first active portion and the second active portion are not deformed, such that the third state and the fourth state are repeated alternately.

17. The liquid droplet jetting apparatus according to claim 16, wherein in the warm-up mode, the voltage applying mechanism applies, to the first active portion and the second active portion, another voltage greater than the voltage applied in the liquid droplet jetting mode, or makes a pulse width of the another voltage applied to the first active portion and the second active portion to be wider than a pulse width of the voltage applied in the liquid droplet jetting mode.

18. The liquid droplet jetting apparatus according to claim 16, wherein the piezoelectric actuator has at least one piezoelectric material layer, a first individual electrode and a second individual electrode which are provided on a side of one surface of the piezoelectric material layer, and a first common electrode which is provided on a side of the other surface of the piezoelectric material layer;

the first individual electrode has a portion corresponding to a central portion, of the pressure chamber, in a width direction of the pressure chamber, and the second individual electrode has a portion corresponding to both side portions in the width direction of the pressure chamber, the first common electrode has a portion corresponding to the first individual electrode and the second individual electrode in the width direction of the pressure chamber, a first active portion is formed in a portion, of the piezoelectric material layer, sandwiched between the first individual electrode and the first common electrode, and a second active portion is formed in a portion, of the piezoelectric material layer, sandwiched between the second individual electrode and the first common electrode; and in the liquid droplet jetting mode, the voltage applying mechanism applies voltage to the piezoelectric actuator such that a ground electric potential is applied to the first common electrode and the second individual electrode and a positive electric potential is applied to the first individual electrode, and then the ground electric potential is applied to the first individual electrode and the first common electrode and a positive electric potential is applied to the second common electrode, and the ground electric potential is applied again to the first common electrode and the second individual electrode and the positive electric potential is applied again to the first individual electrode, and in the warm-up mode, the voltage applying mechanism applies alternately the positive electric potential and the ground electric potential to the first individual electrode and the second individual electrode in a state that the ground electric potential is applied to the first common electrode.

19. The liquid droplet jetting apparatus according to claim 18, wherein when a time during which a pressure wave is propagated one-way in a liquid channel, of the liquid droplet jetting head, including the pressure chambers is AL, the electric potential applying mechanism switches between application of the electric potential and non-application of the electric potential at a timing of 2AL.

20. The liquid droplet jetting apparatus according to claim 16, wherein the piezoelectric actuator has at least one piezoelectric material layer, a third individual electrode and a second common electrode which are provided on a side of one surface of the piezoelectric material layer, and a third common electrode and a fourth common electrode which are provided on a side of the other surface of the piezoelectric material layer; and the third individual electrode has a portion corresponding to a central portion, of the pressure chamber, in a width direction of the pressure chamber; and the second common electrode has a portion corresponding to both side portions in the width direction of the pressure chamber; and the third common electrode and the fourth common electrode have portions corresponding to the second common electrode and the third individual electrode respectively, in the width direction of the pressure chamber; and a first active portion is formed in a portion, of the piezoelectric material layer, sandwiched between the third individual electrode and the third common electrode; and a second active portion is formed in a portion, of the piezoelectric material layer, sandwiched between the second common electrode and the fourth common electrode; and in the liquid droplet jetting mode, the voltage applying mechanism applies voltage to the piezoelectric actuator such that a ground electric potential is applied to the fourth common electrode and a positive electric potential is applied to the third individual electrode, the second common electrode and the third common electrode, then the ground electric potential is applied to the third individual electrode, the third common electrode and the fourth common electrode and a positive electric potential is applied to the second common electrode, and the ground electric potential is applied again to the fourth common electrode and the positive electric potential is applied again to the third individual electrode, the second common electrode, and the third common electrode; and in the warm-up mode, the voltage applying mechanism repeats application and non-application of the positive electric potential to the third individual electrode and the second common electrode in a state that the ground electric potential is applied to the third common electrode and the fourth common electrode.

21. The liquid droplet jetting apparatus according to claim 16, wherein the liquid droplet jetting head has a temperature detector which detects a temperature corresponding to a temperature of the liquid in the pressure chamber, and the voltage applying mechanism selects to perform the warm-up mode only when the temperature of the liquid is not more than a set value.

* * * * *